US011562625B2

(12) United States Patent
Delekta et al.

(10) Patent No.: US 11,562,625 B2
(45) Date of Patent: Jan. 24, 2023

(54) REPEAT ACCRUAL METER MECHANIC FOR A RANDOM BASED GAME OUTCOME

(71) Applicant: Aristocrat Technologies, Inc., Las Vegas, NV (US)

(72) Inventors: Scott Delekta, Las Vegas, NV (US); Allon Englman, Las Vegas, NV (US)

(73) Assignee: ARISTOCRAT TECHNOLOGIES, INC., Las Vegas, NV (US)

( * ) Notice: Subject to any disclaimer, the term of this patent is extended or adjusted under 35 U.S.C. 154(b) by 0 days.

(21) Appl. No.: 16/918,916

(22) Filed: Jul. 1, 2020

(65) Prior Publication Data

US 2022/0005317 A1 Jan. 6, 2022

(51) Int. Cl.
*G07F 17/32* (2006.01)
*G07F 17/34* (2006.01)

(52) U.S. Cl.
CPC ..... *G07F 17/3267* (2013.01); *G07F 17/3213* (2013.01); *G07F 17/34* (2013.01)

(58) Field of Classification Search
CPC ..... G07F 17/3213; G07F 17/34; G07F 17/3244; G07F 17/3267; G07F 17/3209; G07F 17/326; G07F 17/323
See application file for complete search history.

(56) References Cited

U.S. PATENT DOCUMENTS 8,029,358 B2 * 10/2011 Bigelow, Jr. ..... G07F 17/3244 463/25
2004/0053672 A1 * 3/2004 Baerlocher ..... G07F 17/3244 463/20
2004/0242316 A1 * 12/2004 Oles ..... G07F 17/32 463/20
2009/0176563 A1 7/2009 Bennett et al.
2010/0004047 A1 * 1/2010 Acres ..... G07F 17/3244 463/20
2010/0304820 A1 * 12/2010 Okada ..... G07F 17/34 463/16
2011/0111831 A1 5/2011 Seelig et al.
2012/0214580 A1 * 8/2012 Hoffman ..... G07F 17/3255 463/27
2013/0035150 A1 * 2/2013 Owen ..... G07F 17/3265 463/20
2015/0080088 A1 * 3/2015 Smalley ..... G07F 17/3213 463/20
2015/0356829 A1 * 12/2015 Caputo ..... A63F 13/77 463/16
2019/0051096 A1 2/2019 San
2019/0295377 A1 9/2019 Suda et al.

* cited by examiner

*Primary Examiner* — Justin L Myhr
(74) *Attorney, Agent, or Firm* — Blank Rome LLP

(57) ABSTRACT

A repeat accrual meter mechanic for an electronic gaming device is described. An initial credit value for a repeat accrual meter is determined prior to a spin. For the spin, a random based game outcome is generated, where the random based game outcome includes having a credit symbol and a target symbol. An accumulated credit value for the repeat accrual meter is determined based on adding a credit value of the credit symbol to the initial credit value. Afterwards, a repeat value is randomly determined by triggering a repeat credit operation based on the target symbol. The repeat value is indicative of a number of times to credit the accumulated credit value. Finally, a meter distribution amount is determined based on the accumulated credit value and the repeat value.

21 Claims, 13 Drawing Sheets

REPEAT ACCRUAL METER MECHANIC FOR A RANDOM BASED GAME OUTCOME

BACKGROUND

The disclosure relates generally to the field of user interface (UI) design, electronic gaming machines (EGMs) and other electronic gaming devices, and electronic gaming software. More particularly, but not by way of limitation, this disclosure relates to performing gaming device operations that present and implement a repeat accrual meter mechanic for a random based game outcome.

EGMs or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In some cases, a player may qualify for a special mode of the base game, a secondary game, or a bonus game of the base game by attaining a certain winning combination or triggering event in, or related to, the base game, or after the player is randomly awarded the special mode, secondary game, or bonus game. In the special mode, secondary game, or bonus game, the player is given an opportunity to win extra game credits, game tokens or other forms of payout. In the case of "game credits" that are awarded during play, the game credits are typically added to a credit meter total on the EGM and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game (also referenced throughout the disclosure as a "random based game outcome"). Examples of random based game outcomes include slots, video poker, video blackjack, video pachinko, keno, bingo, and lottery outcomes. The games are also designed to return a certain percentage of the amount wagered back to the player over the course of many plays or instances of the game, which is generally referred to as return to player (RTP). The RTP and randomness of the RNG ensure the fairness of the games and are highly regulated. Upon initiation of play, the RNG randomly determines a game outcome and symbols are then selected which correspond to that outcome. Notably, some games may include an element of skill on the part of the player and are therefore not entirely random.

EGMs often depend on usability (e.g., ease of use and player understandability) and new or improved game features to enhance player experiences on the EGMs. Although previous EGMs include various UI features, game features, and backend game processing operations associated with the UI features to improve usability and enhance player experiences, there is a continuous need for further improvement to EGMs and other electronic gaming devices, electronic gaming software, and/or UI design.

SUMMARY

In one implementation a method is described to implement a repeat accrual meter mechanic. The method determines an initial credit value for a repeat accrual meter prior to a spin. For the spin, the method generates a random based game outcome, where the random based game outcome includes having a credit symbol and a target symbol. The method also determines an accumulated credit value for the repeat accrual meter based on adding a credit value of the credit symbol to the initial credit value. Afterwards, the method randomly determines a repeat value by triggering a repeat credit operation based on the target symbol. The repeat value is indicative of a number of times to credit the accumulated credit value. The method determines a meter distribution amount based on the accumulated credit value and the repeat value.

In another implementation, a system comprises memory and a processor operable to interact with the memory. The processor is able to present, with a user interface, an initial credit value for a repeat accrual meter prior to a spin. After presenting a spin on the user interface, the processor presents a random based game outcome with the user interface. The random based game outcome presented on the user interface includes having a credit symbol and a target symbol. The processor then presents an accumulated credit value for the repeat accrual meter based on adding a credit value of the credit symbol to the initial credit value. The processor also presents a repeat value randomly determined by a repeat credit operation based on landing on the target symbol. The repeat value is indicative of a number of times to credit the accumulated credit value. The processor presents a meter distribution amount based on the accumulated credit value and the repeat value.

In another implementation, a system comprises memory and a processor operable to interact with the memory. The processor is able to determine an initial spin count based on a credit symbol trigger count. The credit symbol trigger count is indicative of a number of credit symbols used to trigger a supplemental game feature with the repeat accrual meter. After triggering the supplemental game feature, the processor determines a random based game outcome, where the random based game outcome includes having a credit symbol and a target symbol. The processor then determines an accumulated credit value for the repeat accrual meter based on adding a credit value of the credit symbol to the initial credit value. The processor also randomly determines a repeat value based on a repeat credit operation triggered from landing on the target symbol. The repeat value is indicative of a number of times to credit the accumulated credit value. The processor determines a meter distribution amount based on the accumulated credit value and the repeat value.

In one implementation, each of the above described methods, and variations thereof, may be implemented as a series of computer executable instructions executed on a programmable gaming device. Such instructions may use any one or more convenient programming language. Such instructions may be collected into engines and/or programs and stored in any computer-readable medium or media that is readable and executable by a computer system, mobile device, or other programmable gaming device.

BRIEF DESCRIPTION OF THE DRAWINGS

While certain implementations will be described in connection with the illustrative implementations shown herein, this disclosure is not limited to those implementations. On the contrary, all alternatives, modifications, and equivalents are included within the spirting and scope of the invention as defined by the claims. In the drawings, which are not to scale, the same reference numerals are used throughout the description and in the drawing figures for components and elements having the same structure. If applicable, primed reference numerals are used for components and elements having similar function and construction to those components and elements having the same unprimed reference numerals.

DETAILED DESCRIPTION

Figure 1:
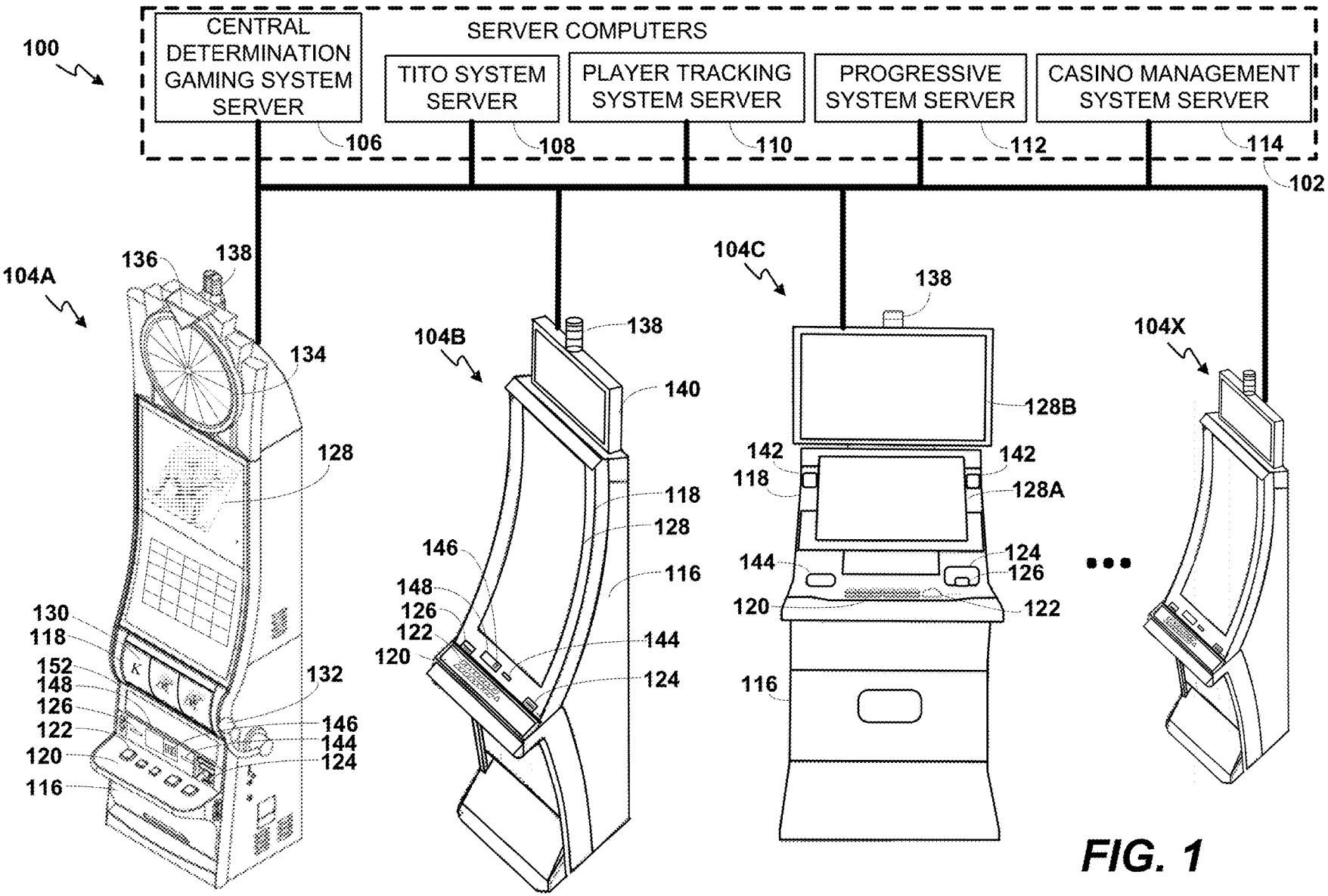
FIG. 1 is an exemplary diagram showing several EGMs networked with various gaming related servers.

The disclosure includes various example implementations that generate a random based game outcome according to a repeat accrual meter mechanic. In one or more implementations, a gaming device provides a repeat accrual meter within a supplemental game feature (e.g., a special mode, secondary game, or bonus game). To trigger the supplemental game feature, the gaming device determines and presents a random based game outcome that satisfies a trigger condition (e.g., landing on six or more credit symbols). After triggering the supplemental game feature, the gaming device sets the repeat accrual meter to an initial credit value (e.g., 500 game credits) based on a credit symbol trigger count and a player's bet multiplier (e.g., ×1 bet multiplier). The gaming device also assigns the number of initial spins (e.g., five initial spins) for the supplemental game feature according to the credit symbol trigger count. For certain implementations, the gaming device ensures at least one of the initial spins lands a target symbol for at least one of the reels. To ensure that at least one of the initial spins lands a target symbol, the gaming device can utilize multiple reel pattern sets and/or a unique reel strip that the gaming device can swap out for one or more reels.

During the supplemental game feature, if a given spin produces a random based game outcome that includes one or more credit symbols landing on the reel strips, the gaming device adds the credit value for each credit symbols (e.g., 100 game credits) to the repeat accrual meter. The updated credit value of the repeat accrual meter after adding the credit values for each credit symbol to the repeat accrual meter is referenced within this disclosure as an "accumulated credit value." If the given spin also generates one or more target symbols (e.g., Wild symbol), the gaming device performs at least one meter disbursement operation based on the accumulated credit value. The meter disbursement operation involves having the gaming device determine a repeat value for a repeat credit operation and award the meter distribution credits to a player based on the accumulated credit value and repeat value for the repeat credit operation. The repeat value represents the number of times the accumulated credit value of the repeat accrual meter is credited to a player. As an example, if a repeat credit operation generates a repeat value of two and the repeat accrual meter has an accumulated credit value of 1,000 game credits, the meter distribution amount awarded to a player is twice the accumulated credit value to a player (e.g., 2×1,000=2,000 game credits). Multiple target symbols can land for a single spin, where each target symbol triggers its own meter disbursement operation.

In terms of technical effects, the repeat accrual meter mechanic delivers improvements to the electronic gaming software, UI design, and/or gaming device by providing new and/or improved gaming device operations that comply with gaming regulations. Regarding UI focused operations, presenting the repeat accrual meter mechanic can improve the usability of the gaming devices, enhance a player's understandability of obtaining certain game outcomes, and provide another approach to presenting how a player could build equity in a game while complying with gaming regulations. With respect to executing new and/or improved gaming device operations, a gaming device is specially programmed to implement a repeat accrual meter mechanic in a computationally effective manner that complies with gaming regulations. Specifically, to achieve a target RTP that complies with gaming regulations, the specially programmed gaming device balances a variety of game parameters associated with the repeat accrual meter mechanic. Examples of game parameters include weighting the repeat value associated with landing a target symbol, setting an initial credit value of the repeat accrual meter after triggering the supplemental game feature, setting target symbol combination frequencies (e.g., frequency that one, two, or three Wilds land for a given a spin), and establishing when and how a target symbol can land during the supplemental game feature. As an example, if a game designer configures a gaming device to trigger relatively higher repeat values at a higher rate/probability, then to maintain the same RTP, the gaming device could be set to generate relatively lower credit values for credit symbols. Additionally, or alternatively, to provide a targeted degree of game volatility, the gaming device can also be specially programmed to utilize a volatility lookup table that dynamically determines the range of the credit values assigned for credit symbols (e.g., low, medium, or high game credit values). The gaming device could also be distinctively encoded to reduce the frequency of generating two or three target symbols for a given spin to accommodate the increase in repeat credit operations. These and other technical features are described in greater detail later in the disclosure.

Example Electronic Gaming Servers, Gaming Devices, and Gaming Environments

FIG. 1 illustrates several different models of EGMs that could be specially configured to generate random based game outcomes using a repeat accrual meter mechanic. As shown in FIG. 1, the EGMs, which are more generally referred to as gaming devices 104A-104X, may be networked to various gaming related servers. Shown is a system 100 in a gaming environment including one or more server computers 102 (e.g., slot servers of a casino) that are in communication, via a communications network, with one or more gaming devices 104A-104X (e.g., EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a website maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency (RF) (e.g., wireless fidelity (WiFi®) and Bluetooth®), cable TV, satellite links and the like.

In some implementation, server computers 102 may not be necessary and/or preferred. For example, in one or more implementations, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The mechanical reels 130 are independently spun and stopped to show a set of symbols within the gaming display area 118 which may be used to determine an outcome to the game.

In many configurations, the gaming device 104A may have a main display 128 (e.g., video display monitor) mounted to, or above, the gaming display area 118. The main display 128 can be a high-resolution liquid crystal display (LCD), plasma, light emitting diode (LED), or organic light emitting diode (OLED) panel which may be flat or curved as shown, a cathode ray tube, or other conventional electronically controlled video monitor.

In some implementations, the bill validator 124 may also function as a "ticket-in" reader that allows the player to use a casino issued credit ticket to load credits onto the gaming device 104A (e.g., in a cashless TITO system). In such cashless implementations, the gaming device 104A may also include a "ticket-out" printer 126 for outputting a credit ticket when a "cash out" button is pressed. Cashless TITO systems are used to generate and track unique bar-codes or other indicators printed on tickets to allow players to avoid the use of bills and coins by loading credits using a ticket reader and cashing out credits using a ticket-out printer 126 on the gaming device 104A. The gaming device 104A can have hardware meters for purposes including ensuring regulatory compliance and monitoring the player credit balance. In addition, there can be additional meters that record the total amount of money wagered on the gaming device, total amount of money deposited, total amount of money withdrawn, total amount of winnings on gaming device 104A.

In some implementations, a player tracking card reader 144, a transceiver for wireless communication with a mobile device (e.g., a player's smartphone), a keypad 146, and/or an illuminated display 148 for reading, receiving, entering, and/or displaying player tracking information is provided in gaming device 104A. In such implementations, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.01 or $0.05), paylines, pay tables, and/or various game related graphics. In some implementations, the information panel(s) 152 may be implemented as an additional video display.

Figure 2A:
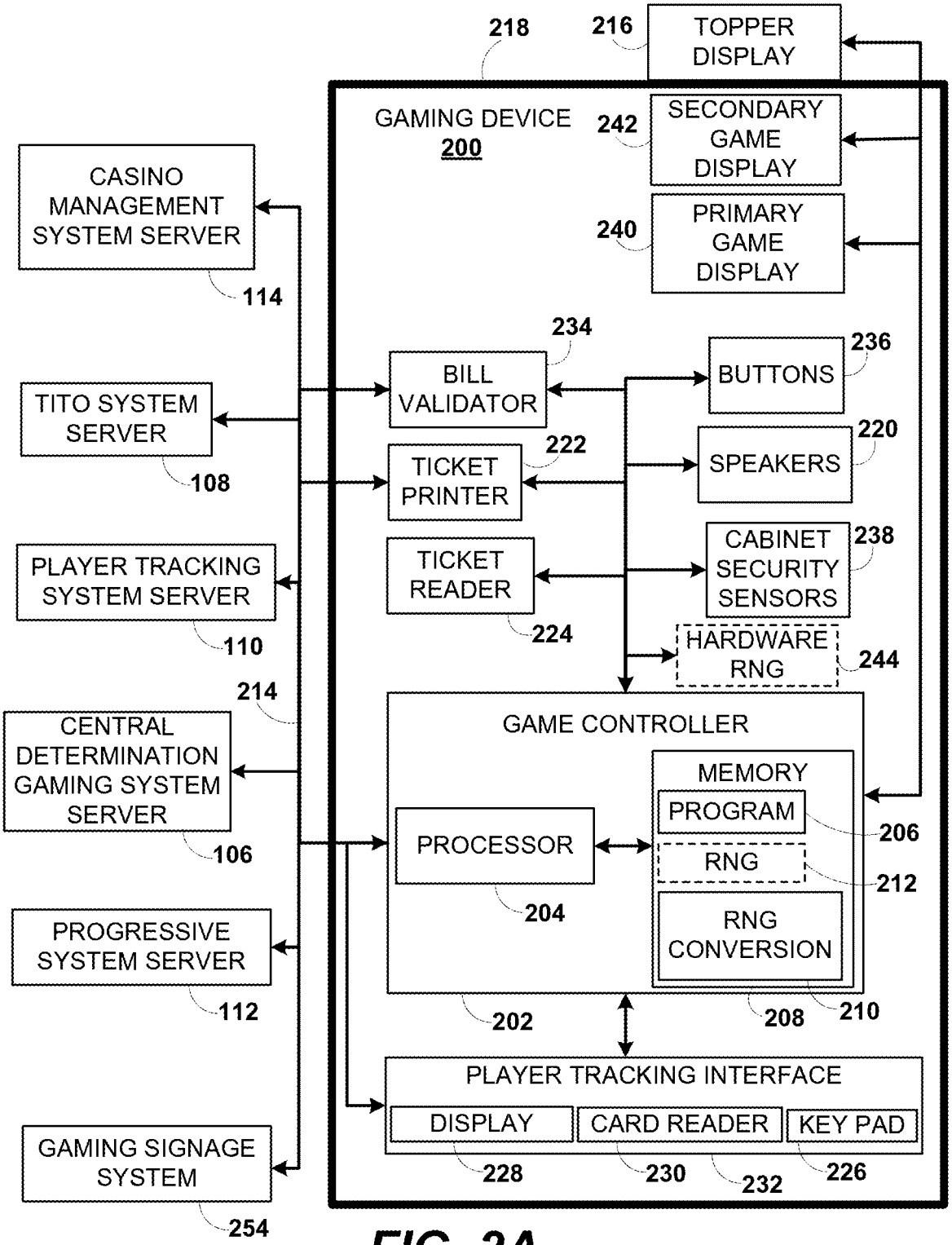
FIG. 2A is a block diagram showing various functional elements of an exemplary EGM.

Gaming devices 104A have traditionally also included a handle 132 typically mounted to the side of main cabinet 116 which may be used to initiate game play. Many or all the above described components can be controlled by circuitry (e.g., a game controller) housed inside the main cabinet 116 of the gaming device 104A, the details of which are shown in FIG. 2A.

An alternative example gaming device 104B illustrated in FIG. 1 is the Arc™ model gaming device manufactured by Aristocrat®Technologies, Inc. Note that where possible, reference numerals identifying similar features of the gaming device 104A implementation are also identified in the gaming device 104B implementation using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some implementations, the optional topper screen 140 may also or alternatively be used to display progressive jackpot prizes available to a player during play of gaming device 104B.

Example gaming device 104B includes a main cabinet 116 including a main door which opens to provide access to the interior of the gaming device 104B. The main or service door is typically used by service personnel to refill the ticket-out printer 126 and collect bills and tickets inserted into the bill validator 124. The main or service door may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the main display 128A may have a curvature radius from top to bottom, or alternatively from side to side. In some implementations, main display 128A is a flat panel display. Main display 128A is typically used for primary game play while secondary display 128B is typically used for bonus game play, to show game features or attraction activities while the game is not in play or any other information or media desired by the game designer or operator. In some implementations, example gaming device 104C may also include speakers 142 to output various audio such as game sound, background music, etc.

Many different types of games, including mechanical slot games, video slot games, video poker, video blackjack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2A is a block diagram depicting exemplary internal electronic components of a gaming device 200 connected to various external systems. All or parts of the gaming device 200 shown could be used to implement any one of the example gaming devices 104A-X depicted in FIG. 1. Similar to FIG. 1, gaming device 200 can be specially configured to generate random based game outcomes using a repeat accrual meter mechanic. As shown in FIG. 2A, gaming device 200 includes a topper display 216 or another form of a top box (e.g., a topper wheel, a topper screen, etc.) that sits above cabinet 218. Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. FIG. 2A also depicts utilizing a ticket printer 222 to print tickets for a TITO system server 108. Gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

The games available for play on the gaming device 200 are controlled by a game controller 202 that includes one or more processors 204. Processor 204 represents a general-purpose processor, a specialized processor intended to perform certain functional tasks, or a combination thereof. As an example, processor 204 can be a central processing unit (CPU) that has one or more multi-core processing units and memory mediums (e.g., cache memory) that function as buffers and/or temporary storage for data. Alternatively, processor 204 can be a specialized processor, such as an application specific integrated circuit (ASIC), graphics processing unit (GPU), field-programmable gate array (FPGA), digital signal processor (DSP), or another type of hardware accelerator. In another example, processor 204 is a system on chip (SoC) that combines and integrates one or more general-purpose processors and/or one or more specialized processors. Although FIG. 2A illustrates that game controller 202 includes a single processor 204, game controller 202 is not limited to this representation and instead can include multiple processors 204 (e.g., two or more processors).

FIG. 2A illustrates that processor 204 is operatively coupled to memory 208. Memory 208 is defined herein as including volatile and nonvolatile memory and other types of non-transitory data storage components. Volatile memory is memory that does not retain data values upon loss of power. Nonvolatile memory is memory that does retain data upon a loss of power. Examples of memory 208 include random access memory (RAM), read-only memory (ROM), hard disk drives, solid-state drives, universal serial bus (USB) flash drives, memory cards (e.g., Compact Fast (CFast) memory card), floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory (SRAM), dynamic random access memory (DRAM), magnetic random access memory (MRAM), and other such devices. Examples of ROM include a programmable read-only memory (PROM), an erasable programmable read-only memory (EPROM), an electrically erasable programmable read-only memory (EEPROM), or other like memory device. Even though FIG. 2A illustrates that game controller 202 includes a single memory 208, game controller 202 could include multiple memories 208 for storing program instructions and/or data.

Memory 208 can store one or more game programs 206 that provide program instructions and/or data for carrying out various implementations (e.g., game mechanics) described herein. Stated another way, game program 206 represents an executable program stored in any portion or component of memory 208. In one or more implementations, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be set up to generate one or more game instances based on instructions and/or data that gaming device 200 exchanges with one or more remote gaming devices, such as a central determination gaming system server 106 (not shown in FIG. 2A but shown in FIG. 1). For purpose of this disclosure, the term "game instance" refers to a play or a round of a game that gaming device 200 presents (e.g., via UI) to a player. The game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a read only memory (ROM)) or from the central determination gaming system server 106 to memory 208.

Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of: (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness. Typically, gaming jurisdictions mandate that gaming devices 200 satisfy a minimum level of randomness without specifying how a gaming device 200 should achieve this level of randomness. To comply, FIG. 2A illustrates that gaming device 200 could include an RNG 212 that utilizes hardware and/or software to generate RNG outcomes that lack any pattern. The RNG operations are often specialized and non-generic in order to comply with regulatory and gaming requirements. For example, in a slot game, game program 206 can initiate multiple RNG calls to RNG 212 to generate RNG outcomes, where each RNG call and RNG outcome corresponds to an outcome for a reel. In another example, gaming device 200 can be a Class II gaming device where RNG 212 generates RNG outcomes for creating Bingo cards. In one or more implementations, RNG 212 could be one of a set of RNGs operating on gaming device 200. More generally, an output of the RNG 212 can be the basis on which game outcomes are determined by the game controller 202. Game developers could vary the degree of true randomness for each RNG (e.g., pseudorandom) and utilize specific RNGs depending on game requirements. The output of the RNG 212 can include a random number or pseudorandom number (either is generally referred throughout this disclosure as a "random number").

In FIG. 2A, RNG 212 and hardware RNG 244 are shown in dashed lines to illustrate that RNG 212, hardware RNG 244, or both can be included in gaming device 200. In one implementation, instead of including RNG 212, gaming device 200 could include a hardware RNG 244 that generates RNG outcomes. Analogous to RNG 212, hardware RNG 244 performs specialized and non-generic operations in order to comply with regulatory and gaming requirements. For example, because of regulation requirements, hardware RNG 244 could be a random number generator that securely produces random numbers for cryptography use. The gaming device 200 then uses the secure random numbers to generate game outcomes for one or more game features (e.g., bonus game, special mode, secondary game, and/or other supplemental game features). In another implementation, the gaming device 200 could include both hardware RNG 244 and RNG 212. RNG 212 may utilize the RNG outcomes from hardware RNG 244 as one of many sources of entropy for generating secure random numbers for the game features.

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%). A game can use one or more lookup tables (also referenced throughout this disclosure as "weighted tables") as part of a technical solution that satisfies regulatory requirements for randomness and RTP. In particular, a lookup table can integrate game features (e.g., trigger events for special modes or bonus games; newly introduced game elements such as extra reels, new symbols, or new cards; stop positions for dynamic game elements such as spinning reels, spinning wheels, or shifting reels; or card selections from a deck) with random numbers generated by one or more RNGs, so as to achieve a given level of volatility for a target level of RTP. In general, volatility refers to the frequency or probability of an event such as a special mode, payout, etc. For example, for a target level of RTP, a higher-volatility game may have a lower payout most of the time with an occasional bonus having a very high payout, while a lower-volatility game has a steadier payout with more frequent bonuses of smaller amounts. Configuring a lookup table can involve engineering decisions with respect to how RNG outcomes are mapped to game outcomes for a given game feature, while still satisfying regulatory requirements for RTP. Configuring a lookup table can also involve engineering decisions about whether different game features are combined in a given entry of the lookup table or split between different entries (for the respective game features), while still satisfying regulatory requirements for RTP and allowing for varying levels of game volatility.

FIG. 2A illustrates that gaming device 200 includes an RNG conversion engine 210 that translates the RNG outcome from RNG 212 to a game outcome presented to a player. To meet a designated RTP, a game developer can set up the RNG conversion engine 210 to utilize one or more lookup tables and/or reel strips to translate the RNG outcome to a symbol element, stop position for a reel strip, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table and/or reel strips to map the RNG outcome to a game outcome displayed to a player and a second lookup table as a pay table for determining the prize payout amount for each game outcome. The mapping between the RNG outcome to the game outcome controls the frequency in hitting certain prize payout amounts.

FIG. 2A also depicts that gaming device 200 is connected over network 214 to player tracking system server 110. Player tracking system server 110 may be, for example, an OASIS® system manufactured by Aristocrat®Technologies, Inc. Player tracking system server 110 is used to track play (e.g., amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment, and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gaming device. The credit balance is used by the player to place wagers on instances of the game and to receive game credit awards based on the outcome of winning instances. The credit balance is decreased by the amount of each wager and increased upon a win. The player can add additional game credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus game or select various items during a feature game). The player may make these selections using the player-input buttons 236, the primary game display 240 which may be a touch screen or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Additionally, or alternatively, gaming devices 104A-104X and 200 can include or be coupled to one or more wireless transmitters, receivers, and/or transceivers (not shown in FIGS. 1 and 2A) that communicate (e.g., Bluetooth® or other near-field communication technology) with one or more mobile devices to perform a variety of wireless operations in a casino environment. Examples of wireless operations in a casino environment include detecting the presence of mobile devices, performing credit, points, comps, or other marketing or hard currency transfers, establishing wagering sessions, and/or providing a personalized casino-based experience using a mobile application. In one implementation, to perform these wireless operations, a wireless transmitter or transceiver initiates a secure wireless connection between a gaming device 104A-104X and 200 and a mobile device. After establishing a secure wireless connection between the gaming device 104A-104X and 200 and the mobile device, the wireless transmitter or transceiver does not send and/or receive application data to and/or from the mobile device. Rather, the mobile device communicates with gaming devices 104A-104X and 200 using another wireless connection (e.g., WiFi® or cellular network). In another implementation, a wireless transceiver establishes a secure connection to directly communicate with the mobile device. The mobile device and gaming device 104A-104X and 200 sends and receives data utilizing the wireless transceiver instead of utilizing an external network. For example, the mobile device would perform digital wallet transactions by directly communicating with the wireless transceiver. In one or more implementations, a wireless transmitter could broadcast data received by one or more mobile devices without establishing a pairing connection with the mobile devices.

Although FIGS. 1 and 2A illustrate specific implementations of a gaming device (e.g., gaming devices 104A-104X and 200), the disclosure is not limited to those implementations shown in FIGS. 1 and 2A. For example, not all gaming devices suitable for implementing implementations of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or tabletops and have displays that face upwards. Gaming devices 104A-104X and 200 may also include other processors that are not separately shown. Using FIG. 2A as an example, gaming device 200 could include display controllers (not shown in FIG. 2A) configured to receive video input signals or instructions to display images on game displays 240 and 242. Alternatively, such display controllers may be integrated into the game controller 202. The use and discussion of FIGS. 1 and 2A are examples to facilitate ease of description and explanation.

Figure 2B:
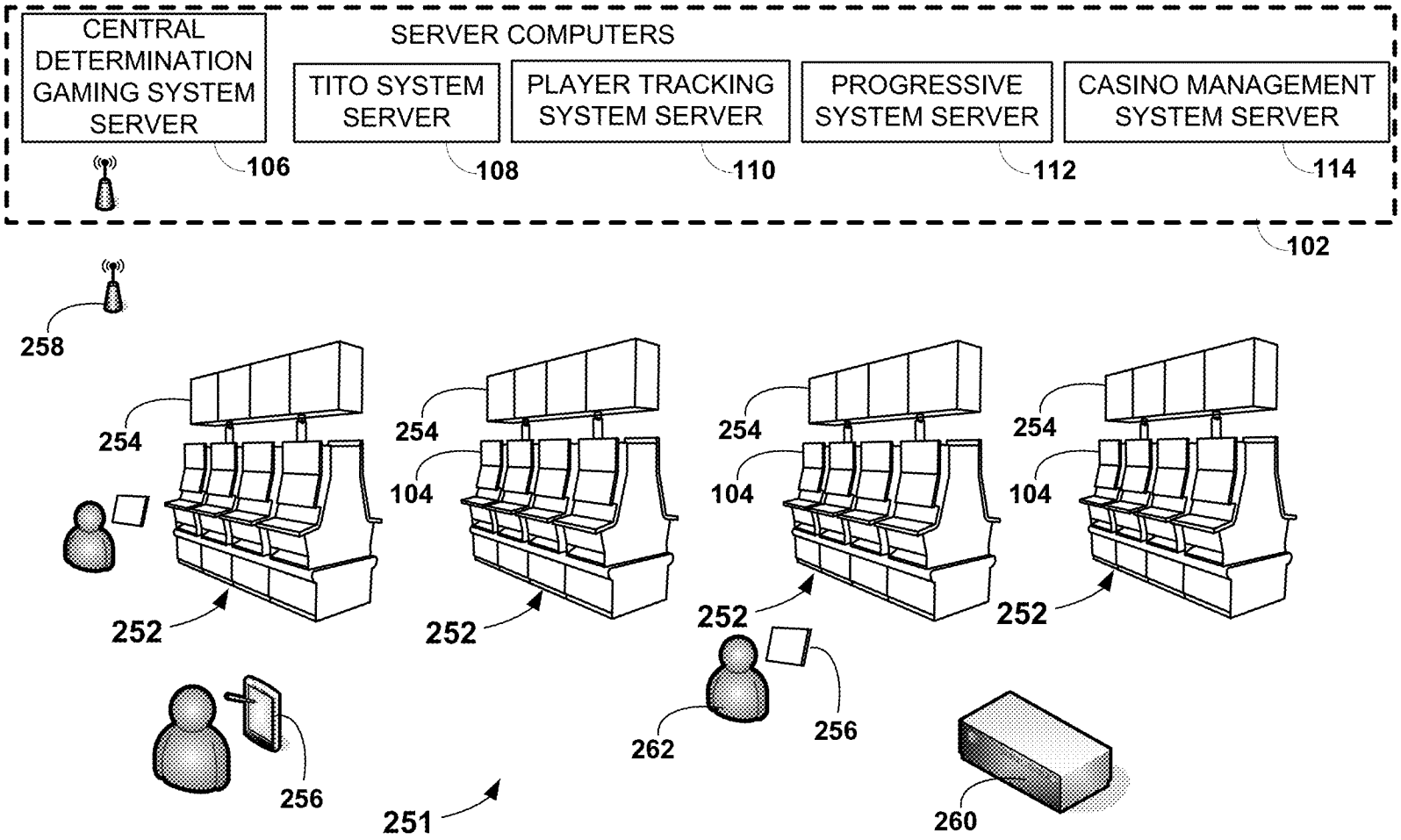
FIG. 2B depicts a casino gaming environment according to one example.

FIG. 2B depicts a casino gaming environment according to one example. In this example, the casino 251 includes banks 252 of EGMs 104. In this example, each bank 252 of EGMs 104 includes a corresponding gaming signage system 254 (also shown in FIG. 2A). According to this implementation, the casino 251 also includes mobile gaming devices 256, which are also configured to present wagering games in this example. The mobile gaming devices 256 may, for example, include tablet devices, cellular phones, smart phones, dedicated gaming consoles, and/or other handheld or portable devices. In this example, the mobile gaming devices 256 are configured for communication with one or more other devices in the casino 251, including but not limited to one or more of the server computers 102, via wireless access points 258.

According to some examples, the mobile gaming devices 256 may be configured for stand-alone determination of game outcomes. However, in some alternative implementations the mobile gaming devices 256 may be configured to receive game outcomes from another device, such as the central determination gaming system server 106, one of the EGMs 104, etc.

Some mobile gaming devices 256 may be configured to accept monetary credits from a credit or debit card, via a wireless interface (e.g., via a wireless payment app), via tickets, via a patron casino account, etc. However, some mobile gaming devices 256 may not be configured to accept monetary credits via a credit or debit card. Some mobile gaming devices 256 may include a ticket reader and/or a ticket printer whereas some mobile gaming devices 256 may not, depending on the particular implementation.

In some implementations, the casino 251 may include one or more kiosks 260 that are configured to facilitate monetary transactions involving the mobile gaming devices 256, which may include cash out and/or cash in transactions. The kiosks 260 may be configured for wired and/or wireless communication with the mobile gaming devices 256. The kiosks 260 may be configured to accept monetary credits from casino patrons 262 and/or to dispense monetary credits to casino patrons 262 via cash, a credit or debit card, via a wireless interface (e.g., via a wireless payment app), via tickets, etc. According to some examples, the kiosks 260 may be configured to accept monetary credits from a casino patron and to provide a corresponding amount of monetary credits to a mobile gaming device 256 for wagering purposes, e.g., via a wireless link such as a near-field communications link. In some such examples, when a casino patron 262 is ready to cash out, the casino patron 262 may select a cash out option provided by a mobile gaming device 256, which may include a real button or a virtual button (e.g., a button provided via a graphical user interface) in some instances. In some such examples, the mobile gaming device 256 may send a "cash out" signal to a kiosk 260 via a wireless link in response to receiving a "cash out" indication from a casino patron. The kiosk 260 may provide monetary credits to the casino patron 262 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 256 and/or a kiosk 260.

Some mobile gaming devices 256 may be configured for receiving and/or transmitting player loyalty information. For example, some mobile gaming devices 256 may be configured for wireless communication with the player tracking system server 110. Some mobile gaming devices 256 may be configured for receiving and/or transmitting player loyalty information via wireless communication with a patron's player loyalty card, a patron's smartphone, etc.

According to some implementations, a mobile gaming device 256 may be configured to provide safeguards that prevent the mobile gaming device 256 from being used by an unauthorized person. For example, some mobile gaming devices 256 may include one or more biometric sensors and may be configured to receive input via the biometric sensor(s) to verify the identity of an authorized patron. Some mobile gaming devices 256 may be configured to function only within a predetermined or configurable area, such as a casino gaming area.

Figure 2C:
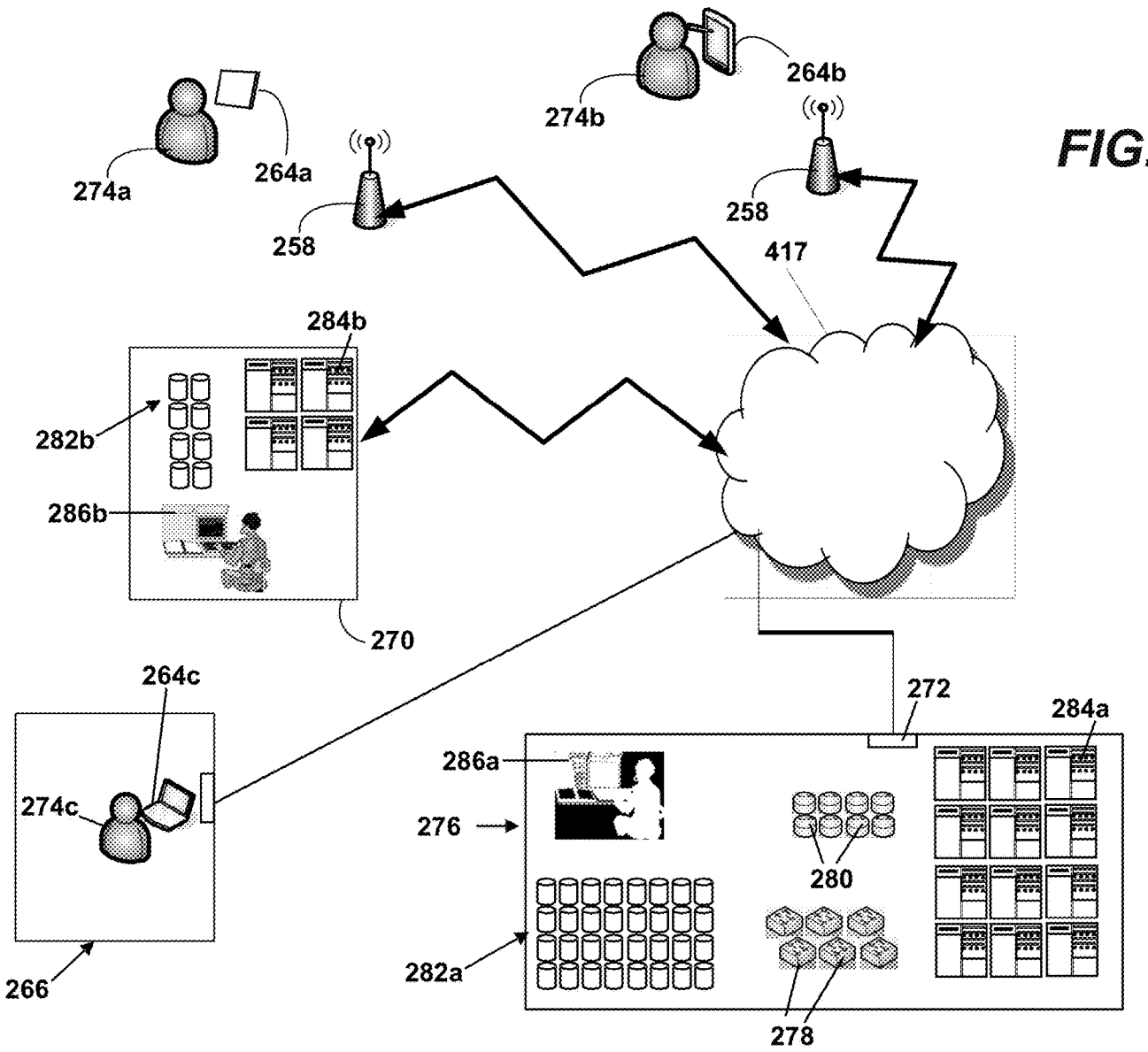
FIG. 2C is a diagram that shows examples of components of a system for providing online gaming according to some aspects of the present disclosure.

FIG. 2C is a diagram that shows examples of components of a system for providing online gaming according to some aspects of the present disclosure. As with other figures presented in this disclosure, the numbers, types and arrangements of gaming devices shown in FIG. 2C are merely shown by way of example. In this example, various gaming devices, including but not limited to end user devices (EUDs) 264*a*, 264*b* and 264*c* are capable of communication via one or more networks 417. The networks 417 may, for example, include one or more cellular telephone networks, the Internet, etc. In this example, the EUDs 264*a* and 264*b* are mobile devices: according to this example the EUD 264*a* is a tablet device and the EUD 264*b* is a smart phone. In this implementation, the EUD 264*c* is a laptop computer that is located within a residence 266 at the time depicted in FIG. 2C. Accordingly, in this example the hardware of EUDs is not specifically configured for online gaming, although each EUD is configured with software for online gaming. For example, each EUD may be configured with a web browser. Other implementations may include other types of EUD, some of which may be specifically configured for online gaming.

In this example, a gaming data center 276 includes various devices that are configured to provide online wagering games via the networks 417. The gaming data center 276 is capable of communication with the networks 417 via the gateway 272. In this example, switches 278 and routers 280 are configured to provide network connectivity for devices of the gaming data center 276, including storage devices 282*a*, servers 284*a* and one or more workstations 570*a*. The servers 284*a* may, for example, be configured to provide access to a library of games for online game play. In some examples, code for executing at least some of the games may initially be stored on one or more of the storage devices 282*a*. The code may be subsequently loaded onto a server

284*a* after selection by a player via an EUD and communication of that selection from the EUD via the networks 417. The server 284*a* onto which code for the selected game has been loaded may provide the game according to selections made by a player and indicated via the player's EUD. In other examples, code for executing at least some of the games may initially be stored on one or more of the servers 284*a*. Although only one gaming data center 276 is shown in FIG. 2C, some implementations may include multiple gaming data centers 276.

In this example, a financial institution data center 270 is also configured for communication via the networks 417. Here, the financial institution data center 270 includes servers 284*b*, storage devices 282*b*, and one or more workstations 286*b*. According to this example, the financial institution data center 270 is configured to maintain financial accounts, such as checking accounts, savings accounts, loan accounts, etc. In some implementations one or more of the authorized users 274*a*-274*c* may maintain at least one financial account with the financial institution that is serviced via the financial institution data center 270.

According to some implementations, the gaming data center 276 may be configured to provide online wagering games in which money may be won or lost. According to some such implementations, one or more of the servers 284*a* may be configured to monitor player credit balances, which may be expressed in game credits, in currency units, or in any other appropriate manner. In some implementations, the server(s) 284*a* may be configured to obtain financial credits from and/or provide financial credits to one or more financial institutions, according to a player's "cash in" selections, wagering game results and a player's "cash out" instructions. According to some such implementations, the server(s) 284*a* may be configured to electronically credit or debit the account of a player that is maintained by a financial institution, e.g., an account that is maintained via the financial institution data center 270. The server(s) 284*a* may, in some examples, be configured to maintain an audit record of such transactions.

In some alternative implementations, the gaming data center 276 may be configured to provide online wagering games for which game credits may not be exchanged for cash or the equivalent. In some such examples, players may purchase game credits for online game play, but may not "cash out" for monetary credit after a gaming session. Moreover, although the financial institution data center 270 and the gaming data center 276 include their own servers and storage devices in this example, in some examples the financial institution data center 270 and/or the gaming data center 276 may use offsite "cloud-based" servers and/or storage devices. In some alternative examples, the financial institution data center 270 and/or the gaming data center 276 may rely entirely on cloud-based servers.

One or more types of devices in the gaming data center 276 (or elsewhere) may be capable of executing middleware, e.g., for data management and/or device communication. Authentication information, player tracking information, etc., including but not limited to information obtained by EUDs 264 and/or other information regarding authorized users of EUDs 264 (including but not limited to the authorized users 274*a*-274*c*), may be stored on storage devices 282 and/or servers 284. Other game-related information and/or software, such as information and/or software relating to leaderboards, players currently playing a game, game themes, game-related promotions, game competitions, etc., also may be stored on storage devices 282 and/or servers 284. In some implementations, some such game-related software may be available as "apps" and may be downloadable (e.g., from the gaming data center 276) by authorized users.

In some examples, authorized users and/or entities (such as representatives of gaming regulatory authorities) may obtain gaming-related information via the gaming data center 276. One or more other devices (such EUDs 264 or devices of the gaming data center 276) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

Example Game Processing Architecture

Figure 3:
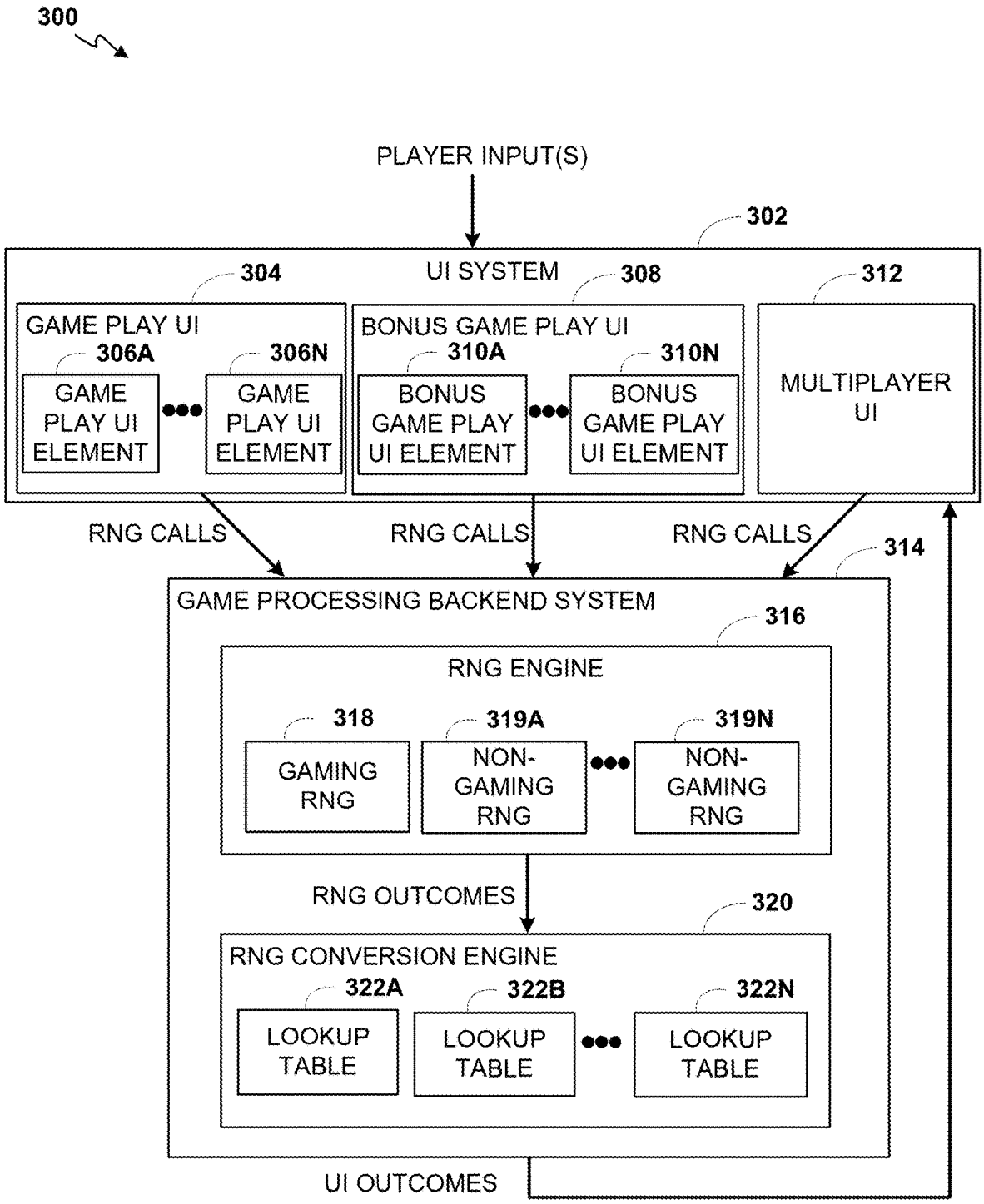
FIG. 3 illustrates, in block diagram form, an embodiment of a game processing architecture that implements a game processing pipeline for the play of a game in accordance with various implementations described herein.

FIG. 3 illustrates, in block diagram form, an implementation of a game processing architecture that implements a game processing pipeline 300 for the play of a game in accordance with various implementations described herein. As shown in FIG. 3, the gaming processing pipeline 300 starts with having a UI system 302 receive one or more player inputs for the game instance. Based on the player input(s), the UI system 302 generates and sends one or more RNG calls to a game processing backend system 314. Game processing backend system 314 then processes the RNG calls with RNG engine 316 to generate one or more RNG outcomes, for example random numbers. The RNG outcomes are then sent to the RNG conversion engine 320 to generate one or more game outcomes for the UI system 302 to display to a player. A gaming device, such as gaming devices 104A-104X and 200 shown in FIGS. 1 and 2A, respectively, can implement the game processing pipeline 300. Alternatively, portions of the game processing pipeline 300 can be implemented using a gaming device and one or more remote gaming devices, such as central determination gaming system server 106 shown in FIG. 1.

The UI system 302 includes one or more UIs that a player can interact with. The UI system 302 could include one or more game play UIs 304, one or more bonus game play UIs 308, and one or more multiplayer UIs 312, where each UI type includes one or more mechanical UIs and/or graphical UIs (GUIs). In other words, game play UI 304, bonus game play UI 308, and the multiplayer UI 312 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3 as an example, the different UI elements are shown as game play UI elements 306A-306N and bonus game play UI elements 310A-310N.

The game play UI 304 represents a UI that a player typically interfaces with for a base game. During a game instance of a base game, the game play UI elements 306A-306N (e.g., GUI elements depicting one or more virtual reels in a reel area) are shown and/or made available to a user. In a subsequent game instance, the UI system 302 could transition out of the base game to one or more bonus games. The bonus game play UI 308 represents a UI that utilizes bonus game play UI elements 310A-310N for a player to interact with and/or view during a bonus game. In one or more implementations, at least some of the game play UI element 306A-306N are similar to the bonus game play UI elements 310A-310N. In other implementations, the game play UI element 306A-306N can differ from the bonus game play UI elements 310A-310N.

In one or more implementations, the game processing pipeline 300 can incorporate the example implementations described herein into various types of reel games. In particular, a reel game includes a base reel game shown with game play UI 304 or bonus reel game shown with bonus game play UI 308. Generally, a base, or primary, reel game includes play that involves spinning reels. A bonus reel game can add the possibility of winning a relatively large payout. A bonus reel game may require an additional wager, but typically does not. For purposes of this disclosure, a bonus reel game can be a type of supplemental game feature the game processing pipeline 300 can implement.

For a reel game, the game play UI 304 and/or bonus game play UI 308 includes a reel area that encloses viewable portions of a set of reels associated with the reel area. For each reel strip, the viewable portion of the reel strips includes one or more positions for symbols. Thus, the reel area is a matrix of symbols on a UI and may be highlighted to emphasize reel strips and symbols within the reel area. The number of reel strips and dimensions of the reel area depend on implementation. In some typical configurations, a reel area has an m×n configuration, with m reels and with n symbols visible per reel. For example, for a base reel game, a reel area can have a 5×3 configuration—five reels per window, with three symbols showing in the window for each of the reels. More generally, the reel area spans m reels in a first dimension and spans n symbols in a second dimension orthogonal to the first dimension, where the value of m can be 4, 5, 6, 7, 8, or some other number of reels, and the value of n can be 2, 3, 4, 5, 6, or some other number of symbols. Typically, the m reels are arranged horizontally in the reel area from left-to-right, with the m reels spinning vertically and the reel area showing n symbols of each of the respective reels. Alternatively, the m reels are arranged vertically in the reel area from top-to-bottom, with the m reels spinning horizontally and the reel area showing n symbols of each of the respective reels. Alternatively, a reel area can have another configuration. For example, a reel area can have different numbers of symbols visible for different reels (e.g., going left to right in a reel area, two symbols visible for a leftmost reel, three symbols visible for a second reel, four symbols visible for a center reel, three symbols visible for a fourth reel, and two symbols visible for a rightmost reel), or as further explained below, a reel area can have a p×q configuration, with p×q reels visible in a rectangular reel area, and a single symbol visible per reel.

FIG. 3 also illustrates that UI system 302 could include a multiplayer UI 312 purposed for game play that differs or is separate from the typical base game. For example, multiplayer UI 312 could be set up to receive player inputs and/or presents game play information relating to a tournament mode. When a gaming device transitions from a primary game mode that presents the base game to a tournament mode, a single gaming device is linked and synchronized to other gaming devices to generate a tournament outcome. For example, multiple RNG engines 316 corresponding to each gaming device could be collectively linked to determine a tournament outcome. To enhance a player's gaming experience, tournament mode can modify and synchronize sound, music, reel spin speed, and/or other operations of the gaming devices according to the tournament game play. After tournament game play ends, operators can switch back the gaming device from tournament mode to a primary game mode to present the base game. Although FIG. 3 does not explicitly depict that multiplayer UI 312 includes UI elements, multiplayer UI 312 could also include one or more multiplayer UI elements.

Based on the player inputs, the UI system 302 could generate RNG calls to a game processing backend system 314. As an example, the UI system 302 could use one or more application programming interfaces (APIs) to generate the RNG calls. To process the RNG calls, the RNG engine 316 could utilize gaming RNG 318 and/or non-gaming RNGs 319A-319N. Gaming RNG 318 could corresponds to RNG 212 or hardware RNG 244 shown in FIG. 2A. As previously discussed with reference to FIG. 2A, gaming RNG 318 often performs specialized and non-generic operations that comply with regulatory and/or game requirements. For example, because of regulation requirements, gaming RNG 318 could correspond to RNG 212 by being a cryptographic RNG or pseudorandom number generator (PRNG) (e.g., Fortuna PRNG) that securely produces random numbers for one or more game features. To securely generate random numbers, gaming RNG 318 could collect random data from various sources of entropy, such as from an operating system (OS) and/or a hardware RNG (e.g., hardware RNG 244 shown in FIG. 2A). Alternatively, non-gaming RNGs 319A-319N may not be cryptographically secure and/or be computationally less expensive. Non-gaming RNGs 319A-319N can, thus, be used to generate outcomes for non-gaming purposes. As an example, non-gaming RNGs 319A-319N can generate random numbers for generating random messages that appear on the gaming device.

The RNG conversion engine 320 processes each RNG outcome from RNG engine 316 and converts the RNG outcome to a UI outcome that is feedback to the UI system 302. With reference to FIG. 2A, RNG conversion engine 320 corresponds to RNG conversion engine 210 used for game play. As previously described, RNG conversion engine 320 translates the RNG outcome from the RNG 212 to a game outcome presented to a player. As an example, in a reel game, to determine the game outcome, the RNG conversion engine 320 includes reel strips that vary in symbol pattern and reel strip length. Each reel strip includes x positions along a one-dimensional strip of symbols, where x depends on implementation. For example, x is 30, 80, 100, 200, or some other number of positions. The value of x can be the same or different for different reels (thus, different reels can have different numbers of positions). Each reel can have a data structure (e.g., array, linked list) that tracks the symbols at the respective positions of the reel strip for the reel. In some example implementations, the configuration of the symbols at the positions of the reel strips for the reels of a reel game is fixed after the reel game boots, although limited reconfiguration operations may be permitted. In other example implementations, the configuration of the symbols at the positions of the reel strips for the reels of a reel game can change dynamically after the reel game boots (e.g., depending on bet level or some other factor). Different sets of reels can be used for a base reel game and bonus reel game (or other supplemental game feature such as a special mode of the base reel game). For example, for a special mode of a base reel game, more "valuable" symbols or target symbols, such as wild symbols or scatter symbols, can be added to the reels of a base reel game or swapped in for other symbols on the reels.

RNG conversion engine 320 could also utilizes one or more lookup tables 322A-322N, which are also called weighted tables, to regulate a prize payout amount for each RNG outcome and how often the gaming device pays out the derived prize payout amounts. To do so, RNG conversion engine 320 can determine various game outcomes and perform operations for various types of base game features and/or supplemental game features (e.g., a bonus game). Although not shown in FIG. 3, the RNG conversion engine 320 could store and/or utilize one or more sets of reel strips, where each set of reel strips has different reel strip patterns. The RNG conversion engine 320 can also store (e.g., as data structures) and/or utilize one or more lookup tables 322 to assign probabilities to different options. For example, the RNG conversion engine 320 selects one of the different options based on a random number for the RNG outcome, where the different options are represented in different entries of a lookup table 322.

In one or more implementations, for a given lookup table 322, the probabilities for different options can be reflected in table entry values (e.g., for a random number RND associated with a RNG outcome, generated by an RNG, in the range of 0<RND<=40 for option 1, 40<RND<=70 for option 2, 70<RND<=90 for option 3, and 90<RND<=100 for option 4, given four options and a random number RND where 0<RND<=100). The table entry values can represent percentages or, more generally, sub-ranges within the range for a random number. In some implementations, the table entry values for a lookup table 322 are represented as count values (which can also be referend throughout the disclosure as "weights") for the respective entries of the lookup table. As an example, the following table shows count values for the four options described above:

TABLE 1

Example Lookup Table

| count value | entry |
|---|---|
| 40 | <value a1, value a2, . . .> |
| 30 | <value b1, value b2, . . .> |
| 20 | <value c1, value c2, . . .> |
| 10 | <value d1, value d2, . . .> |

The sum total of the count values indicates the range of the options. The game processing backend system 314 can use a random number for an RNG outcome, generated between 1 and the sum total of the count values, to select one of the entries in the lookup table 322 by comparing the random number to successive running totals. In the example shown in Table 1, if the random number for the RNG outcome is 40 or less, the RNG conversion engine 320 selects the first entry. Otherwise, if the random number for the RNG outcome is between 41 and 70, RNG conversion engine 320 selects the second entry. Otherwise, if the random number for the RNG outcome is between 71 and 90, the RNG conversion engine 320 selects the third entry. Otherwise, the RNG conversion engine 320 selects the last entry. The table entry values for a lookup table 322 can be fixed and predetermined, can vary dynamically (e.g., depending on bet level), or can be dynamically selected (e.g., depending on bet level, depending on another factor) from among multiple available lookup tables. Different game parameters or choices during game play can use different lookup tables 322, or different combinations of game parameters or choices can be combined in entries of a given lookup table 322.

In general, after the reel strips have landed to produce a random based game outcome (also referenced throughout the disclosure as "reel stops"), the game processing backend system 314 identifies any win conditions and any win amounts to award to the player (e.g., credited to the player's credit balance). In some examples, win conditions depend on a count of credit symbols that land after the reel stops. In other examples, win conditions are defined as paylines (also called win lines) across at least a portion of a reel area on a display screen. For a round of play, game processing backend system 314 awards a win amount when a certain combination of symbols appears along a payline. Win amounts can vary according to the combination of symbols and according to the particular payline along which the combination of symbols land. In one or more implementations, instead of evaluating win conditions on paylines across reels, the game processing backend system 314 can determine an award according to a "ways" approach. The game processing backend system 314 typically determines the win amounts according to a pay table, where the pay table comprehends the various combinations of symbols and/or paylines that may occur (e.g., the win conditions). The win amount for a round of play may be a fraction of an amount wagered for that round of play for certain win conditions. For other win conditions, the win amount may be much larger than the amount wagered.

After generating the UI outcome, the game processing backend system 314 sends the UI outcome to the UI system 302. Examples of UI outcomes are symbols to display on a video reel or reel stops for a mechanical reel. In one example, if the UI outcome is for a base game, the UI system 302 updates one or more game play UI elements 306A-306N, such as symbols, for the game play UI 304. In another example, if the UI outcome is for a bonus game, the UI system could update one or more bonus game play UI elements 310A-310N (e.g., symbols) for the bonus game play UI 308. In response to updating the appropriate UI, the player may subsequently provide additional player inputs to initiate a subsequent game instance that progresses through the game processing pipeline 300.

Repeat Accrual Meter Mechanic

With reference to FIG. 3, to implement the repeat accrual meter mechanic in a supplemental game feature, the UI system 302 could initially present a base game to a player using the game play UI 304. After a player sets a wagering amount and initiates one or more spins, the game play UI 304 may eventually present to a player a random based game outcome that satisfies a trigger condition for the supplemental game feature that contains the repeat accrual meter mechanic. As an example, for a given reel spin, when the game play UI 304 presents a random based game outcome where the credit symbol trigger count exceeds the trigger condition (e.g., six or more credit symbols land in a reel area for a single reel spin), the UI system 302 presents an animation that transitions the game from the game play UI 304 to the bonus game play UI 308. After entering the supplemental game feature, the bonus game play UI 308 presents bonus game play UI elements 310A-310N, such as a banner that notifies the player that the game has entered the supplemental game feature, the initial credit value of the repeat accrual meter, and the number of initial spins earned for the supplemental game feature. To produce the bonus game play UI 308, the bonus game play UI elements 310A-310N could include a graphical indicator to represent the repeat accrual meter, text information for representing credit value for the repeat accrual meter, and a graphical indicator representing the number of spins left for the supplemental game feature.

In one or more implementations, after triggering the supplement game feature, the game processing pipeline 300 can utilize the game processing backend system 314 indirectly determine the initial credit value of the repeat accrual meter. To indirectly determine the initial credit value, the game processing backend system 314 performs a lookup using a lookup table 322 that maps the number of credit symbols that triggered the supplemental game feature (also reference throughout the disclosure as the "credit symbol trigger count") to a fixed table value. As an example, if the credit symbol trigger count is seven, the lookup table 322 returns a fixed table value of 200; if the credit symbol trigger count is eight credit symbols, then lookup table 322 returns a fixed table value of 300 and so forth. In one implementation, the game processing backend system 314 then combines the fixed table value with one or more game parameters (e.g., player's bet multiplier, bet level, and/or denomination value) to dynamically compute the initial credit value to be displayed in the bonus game play UI 308. Continuing with the example of having a credit symbol trigger count of seven and a fixed table value of 200, if the player's bet player's bet multiplier is set to two, then the game processing backend system 314 could compute the initial credit value to be 400 game credits (e.g., 200×2=400 game credits). The game processing backend system 314 could send this information back to the UI system 302, where the bonus game play UI 308 would present 400 game credits as the initial credit value of the repeat accrual meter. Having the initial credit value determined from a player's bet level and/or bet multiplier can generate an appropriately scaled initial credit value that matches a player's wager while maintaining a target RTP. Stated another way, by utilizing a player's bet level and/or bet multiplier, the game processing pipeline 300 is able to normalize the RTP across each bet level. In another implementation, the fixed table value returned from the lookup table 322 directly represents the initial credit value of the repeat accrual meter. In other words, the game processing backend system 314 would not combine (e.g., multiply) the player's bet multiplier or other game parameters with the fixed table value to determine the initial credit value.

The game processing backend system 314 could support other implementations for determining the initial credit value of the repeat accrual meter. In one implementation, the game processing backend system 314 directly determines the initial credit value by adding up all credit values for the credit symbols that triggered the supplemental game feature. For example, to satisfy the trigger condition, if the UI system 302 presents a game outcome of six credit symbols landing on the reel area and each credit symbol has a credit value of 200, then the game processing backend system 314 computes 1,200 game credits as the initial credit value of the repeat accrual meter. In other implementations, the game processing backend system 314 can randomly determine the initial credit value based on the credit symbol trigger count and/or other game parameters (e.g., the player's bet multiplier). Referring to FIG. 3 as an example, to randomly determine the initial credit value, the game processing pipeline 300 initiates an RNG call to the game processing backend system 314. The gaming RNG 318 generates an RNG outcome that the RNG conversion engine 320 utilizes to perform a lookup on one or more lookup tables 322. For example, each lookup table 322 maps a designated credit symbol trigger count to a range of table values. In another example, the game processing pipeline 300 utilizes a single lookup table 322 that maps all designated credit symbol trigger counts to one or more table value ranges. Based on the RNG outcome and the credit symbol trigger count, the RNG conversion engine 320 returns a randomized table value that the game processing pipeline 300 can then combine with one or more game parameters, such as the player's bet multiplier, to determine the initial credit value displayed in the bonus game play UI 308. As an example, the game processing pipeline 300 can multiply the randomized table value (e.g., 200) by the player's bet multiplier (e.g., ×3) to compute the initial credit value (e.g., 200×3=600 game credits).

The game processing backend system 314 can also determine the initial number of spins for a supplemental game feature with the repeat accrual meter mechanic in a variety of ways. In one implementation, the game processing backend system 314 can provide a fixed number of initial spins (e.g., five initial spins) for all credit symbol trigger counts (e.g., six or more credit symbols). In other implementations, similar to determining the initial credit value for the repeat accrual meter, the game processing backend system 314 can provide the initial number of spins based on the credit symbol trigger count and/or one or more other game parameters (e.g., the player's bet level). As an example, the game processing backend system 314 can indirectly determine the initial number of spins using a lookup table 322 that maps the credit symbol trigger count to a fixed table value. The fixed table value could represent the initial number of spins or a value that may be combined with one or more other game parameters, such as player's bet level, to indirectly determine the initial number of spins. In another example, the game processing backend system 314 can randomly determine the based on the credit symbol trigger count and/or other game parameters using one or more lookup tables 322. The lookup tables 322 map the credit symbol trigger count to a range of tables values that can represent the initial number of spins or be combined with other game parameters (e.g., the player's bet level) to determine the initial numbers of spins.

After entering the supplemental game feature, for one or more spins, the game processing backend system 314 randomly selects a reel pattern set to use for a set of reels (e.g., reels 1-5). In one example, the game processing backend system 314 could define two reel pattern sets, "reel pattern set A" and "reel pattern set B," to use for one or more spins in the supplemental game feature. The two different reel pattern sets could have the same symbol patterns for all reel strips but with different weights. Alternatively, the two different reel pattern sets could have different symbol patterns with different weights for at least one reel strip for the set of reels (e.g., reels 1-5). To randomly select a reel pattern set to use for one or more spins, the game processing backend system 314 performs one or more RNG pulls from (previously referenced within this disclosure as a "lookup") one or more lookup tables 322. Recall that the game processing backend system 314 can determine an initial number of spins for the supplemental game feature. Using FIG. 3 as an example, the game processing backend system 314 initiates an RNG pull of a lookup table 322 (e.g., lookup table 322B) to randomly select which spin(s) (e.g., spin 2 out of the 5 initial spins) will use a specified reel pattern set (e.g., reel pattern set B). The game processing pipeline 300 designates another reel pattern set (e.g., reel pattern set A) to be used for other initial spins that were not selected. For each spin after the initial spins (e.g., spin 6 of the supplemental game feature), the game processing backend system 314 performs another RNG pull from a different lookup table 322 (e.g., lookup table 322C) to determine which reel pattern set to use.

By using different reel pattern sets, the game processing pipeline 300 can be configured to ensure certain operations or events will occur while complying with gaming regulation. For example, a game designer may setup a supplemental game feature such that a player receives credit from the repeat accrual meter only when a target symbol lands on a given spin. Specifically, when the target symbol lands on a reel for a given spin, the game processing pipeline 300 triggers a meter disbursement operation. The meter disbursement operation awards game credits to a player based on the accumulated credit value of the repeat accrual meter and a repeat value associated with a repeat credit operation. The repeat value represents the number of times the game processing pipeline 300 will credit the accumulated credit value of the repeat accrual meter to a player. If a target symbol fails to land on any of the spins during the supplemental game feature, then a player would not receive an award from the repeat accrual meter. To prevent the possibility that a player fails to trigger a meter disbursement operation in the supplemental game feature, the game processing pipeline 300 uses the capability of selecting different reel pattern sets for one or more spins in conjunction with a unique reel strip that guarantees producing a target symbol for any reel spin. In particular, the game processing backend system 314 can use a lookup table 322 to substitute the unique reel strip for one or more reels (e.g., reels 2 and 3) for a specific reel pattern set (e.g., reel pattern set B).

In one or more implementations, the game processing pipeline 300 can also dynamically populate at least one reel strip by randomly selecting a volatility level. As an example, for a given spin, each reel strip in a set of reels (e.g., reels 1-5) could include one or more credit symbols that the game processing pipeline 300 can dynamically adjust their corresponding credit values. To dynamically adjust the credit values for each credit symbol, game processing pipeline 300, initiates an RNG call for each credit symbol to pull from a volatility lookup table (e.g., lookup table 322N). The volatility lookup table maps the RNG outcome to a certain volatility level, such as low volatility, medium volatility, or high volatility. Based on the assigned volatility, the game processing pipeline 300 populates a credit value for a credit symbol. In addition to the volatility level, the game processing pipeline 300 can base the credit value for a credit symbol on other game parameters, such as the credit denomination value (e.g., 1 cent denomination), a player's bet level (e.g., 88 game credits), and/or a player's bet multiplier.

After populating the reel strips for a set of reels to use for a given spin, the game processing pipeline 300 initiates multiple RNG calls to determine the game outcome for the given spin. For example, if the supplemental game feature includes five reels, the game processing pipeline 300 initiates a total of five RNG calls, one RNG call for each reel strip, to the game processing backend system 314 to determine the reel stop for each reel. The game processing pipeline 300 adds the credit values of all credit symbols that land to the repeat accrual meter to generate an accumulated credit value. If one or more target symbols also land based on the reel stops, the game processing pipeline 300 performs a meter disbursement operation for each target symbol. Each meter distribution operation performs a repeat credit operation that determines a repeat value and credits the accumulated credit value of the repeat accrual meter to a player according to the repeat value. When a repeat credit operation triggers, the game processing pipeline 300 performs an RNG call to pull from one or more lookup tables 322 that maps the RNG outcome to the repeat value. As an example, the game processing backend system 314 can include a single lookup table 322 that returns the repeat value. Alternatively, to return the repeat value, the game processing backend system 314 can include multiple lookup tables 322, where each lookup table 322 corresponds to a specific reel pattern set.

Figure 4:
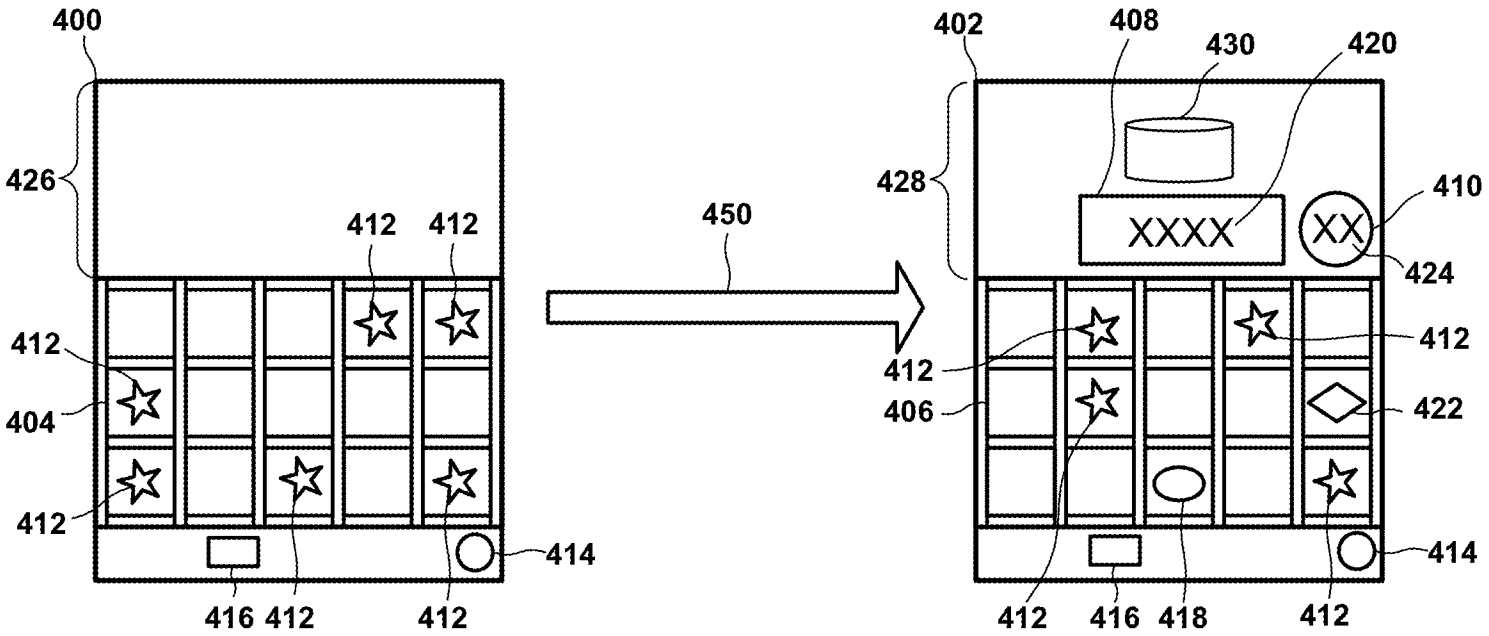
FIG. 4 is a diagram that depicts example general layouts of UIs related to triggering or presenting the repeat accrual meter mechanic.

FIG. 4 is a diagram that depicts example general layouts of UIs related to triggering or presenting the repeat accrual meter mechanic. A gaming device can present the UIs shown in FIG. 4 (e.g., initial game UI 400 and the supplemental game feature UI 402) and other UIs when executing a game program. Using FIG. 2A as an example, when a gaming device 200 executes game program 206, the gaming device 200 displays the initial game UI 400 and the supplemental game feature UI 402 on primary game display 240 and/or secondary game display 242. Additionally, or alternatively, at least some or all portions of the initial game UI 400 and/or supplemental game feature UI 402 could be presented on mechanical reels and/or other types of mechanical and/or electro-mechanical components not shown in FIG. 2A. The initial game UI 400 corresponds to a UI for a base game or another supplemental game feature without the repeat accrual meter mechanic (e.g., a free games bonus game). The supplemental game feature UI 402 represents a UI for a supplemental game feature that presents one or more aspects of the repeat accrual meter mechanic, such as repeat accrual meter 408 and remaining spin meter 410.

In FIG. 4, both the initial game UI 400 and the supplemental game feature UI 402 include a denomination indicator 414 and a bet level indicator 416 to present a player's wager. The denomination indicator 414 presents the game denomination value for a game credit. In one or more implementations, the game denomination value represents the monetary value to game credit conversion. For example, if the denomination indicator 414 presents one cent as the game denomination value, then the exchange rate for one game credit is one cent. Based on a one cent denomination, a gaming device that wagers 100 game credits amounts to wagering one dollar. In another example, if the denomination indicator 414 presents five cents as the game denomination value, then one game credit represents five cents. Based on a five cents denomination, wagering 100 game credits amounts to wagering five dollars. The bet level indicator 416 presents the player's bet level in game credits wagered for a given spin in a base game and/or a supplemental game feature. As an example, for a given spin, the bet level indicator 416 can present the player's bet level is 88 game credits. The bet level indicator 416 could present other player bet levels, such as 176, 264, 440, and 880 game credits.

The initial game UI 400 and the supplemental game feature UI 402 include reel areas 404 and 406 for a reel game. FIG. 4 illustrates that both real areas 404 and 406 include a 5×3 reel configuration that corresponds to five vertical reels (e.g., reels 1-5) that are three symbols high. As a result, for a given reel stop, each reel area 404 and 406 presents a total of 15 symbol positions, where each reel in reel areas 404 and 406 presents three symbol positions. Other implementations of the initial game UI 400 and/or the supplemental game feature UI 402 could have other reel configurations (e.g., 5×4 reel configuration) that present a different number of symbol positions (e.g., 20 symbol positions). Additionally, or alternatively, the initial game UI and supplemental game feature UI 402 could have differing reel configurations. Using FIG. 4 as an example, although the supplemental game feature UI 402 presents a 5×3 reel configuration for reel area 406, other implementations could present an animation that depicts one or more reels in reel area 406 growing to six symbols tall (e.g., 5×6 reel configuration).

The initial game UI 400 and the supplemental game feature UI 402 can also include other gameplay areas 426 and 428 to present other game elements. As shown in FIG. 4, gameplay areas 426 and 428 are located outside of reel areas 404 and 406, respectively. Examples of other game elements that could be found within gameplay areas 426 and 428 include metamorphic graphical elements, jackpot prize indicators, and/or game theme graphics. In one or more implementations, the metamorphic graphical element 430 shown in the supplemental game feature UI 402 can be configured to dynamically change based on the repeat accrual meter mechanic. Specifically, the supplemental game feature UI 402 can synchronize the metamorphic graphical element 430 to the repeat accrual meter mechanic in order to convey the occurrence of important or notable random based game outcomes, such as increases in the accumulated credit value of the repeat accrual meter and/or the occurrence of triggering a meter distribution operation.

When initial game UI 400 presents a random based game outcome that triggers a supplemental game feature with the repeat accrual meter mechanic, the initial game UI 400 transitions to the supplemental game feature UI 402. FIG. 4 depicts that the initial game UI 400 presents a random based game outcome that produces six credit symbols 412 in six different symbol positions in reel area 404. Having six credit symbols 412 land in six different symbol positions in reel area 404 satisfies the supplement game feature's trigger condition (e.g., landing on six or more credit symbols in a given spin). Because the random based game outcome satisfies the trigger condition, a gaming device presents a transition animation 450 indicating to a player that the game is leaving the initial game play (e.g., base game) and entering the supplemental game feature. After the transition animation 450 completes, the gaming device presents the supplemental game feature UI 402 to the player. In other implementations, the initial game UI 400 may present other trigger conditions that use other symbol types, such as landing 3 or more scatter symbols, or credit symbol trigger counts to trigger the supplemental game feature UI 402.

To present the repeat accrual meter mechanic to a player, the supplemental game feature UI 402 includes a repeat accrual meter 408 and a remaining spin meter 410. The supplemental game feature UI 402 presents a credit value 420 within the repeat accrual meter 408 and a remaining spin count 424 within the remaining spin meter 410. When a gaming device initially enters the supplemental game feature UI 402, the credit value 420 is set to the initial credit value and the remaining spin count 424 is set to the initial spin count. Recall that determining the initial credit value and the initial spin count was previously discussed with reference to FIG. 3 and will be also discussed later in the disclosure with reference to FIG. 10.

The supplemental game feature UI 402 adjusts the credit value 420 and/or remaining spin count 424 each time the gaming device generates a random based game outcome. In FIG. 4, the supplemental game feature UI 402 presents a random based game outcome that produces four credit symbols 412 on a given spin. Based on the four credit symbols, the supplemental game feature UI 402 may present one or more animations to adjust credit value 420 according to the populated credit values of the four credit symbols. If the random based game outcome produces an add spin symbol 422, the supplemental game feature UI 402 could present an animation that increments the remaining spin count 424 according the spin value associated with the add spin symbol 422. As an example, if the add spin symbol 422 provides one additional spin (e.g., +1 spin), then the spin symbol 422 adds one spin to the remaining spin count 424; if the add spin symbol 422 provides two additional spins (+2 spin), then the spin symbol 422 adds two spins to the remaining spin count 424, and so forth. The supplemental game feature UI 402 could also present an animation or other visual effect to decrement the remaining spin count 424 each time the gaming device presents an additional random based game outcome.

The supplemental game feature UI 402 in FIG. 4 shows that the random based game outcome also produces a target symbol 418 on the given spin. By landing on a target symbol 418, the gaming device triggers a meter disbursement operation that determines a game credit total to award a player based on the accumulated credit value of the repeat accrual meter and a determined repeat value. As previously discussed with reference to FIG. 3, the meter disbursement operation includes determining a repeat value that identifies the number of times the accumulated credit value of the repeat accrual meter is credited to a player. As an example, if the meter disbursement operation generates a repeat value of three and the repeat accrual meter has an accumulated credit value of 2,000 game credits, the meter distribution amount will be three times the accumulated credit value to a player (e.g., 3×2,000 game credits=6,000 game credits). In one or more implementations, the supplemental game feature UI 402 may convey or communicate the repeat value to a player by altering states of the metamorphic graphical element 430, presenting animations, and/or other generating other visual effects shown in gameplay area 428 and/or reel area 406. Additionally, or alternatively, a gaming device could also utilize auditory effects in conjunction with the visual effects shown in the supplemental game feature UI 402 to communicate the repeat value to the player.

Figure 5:
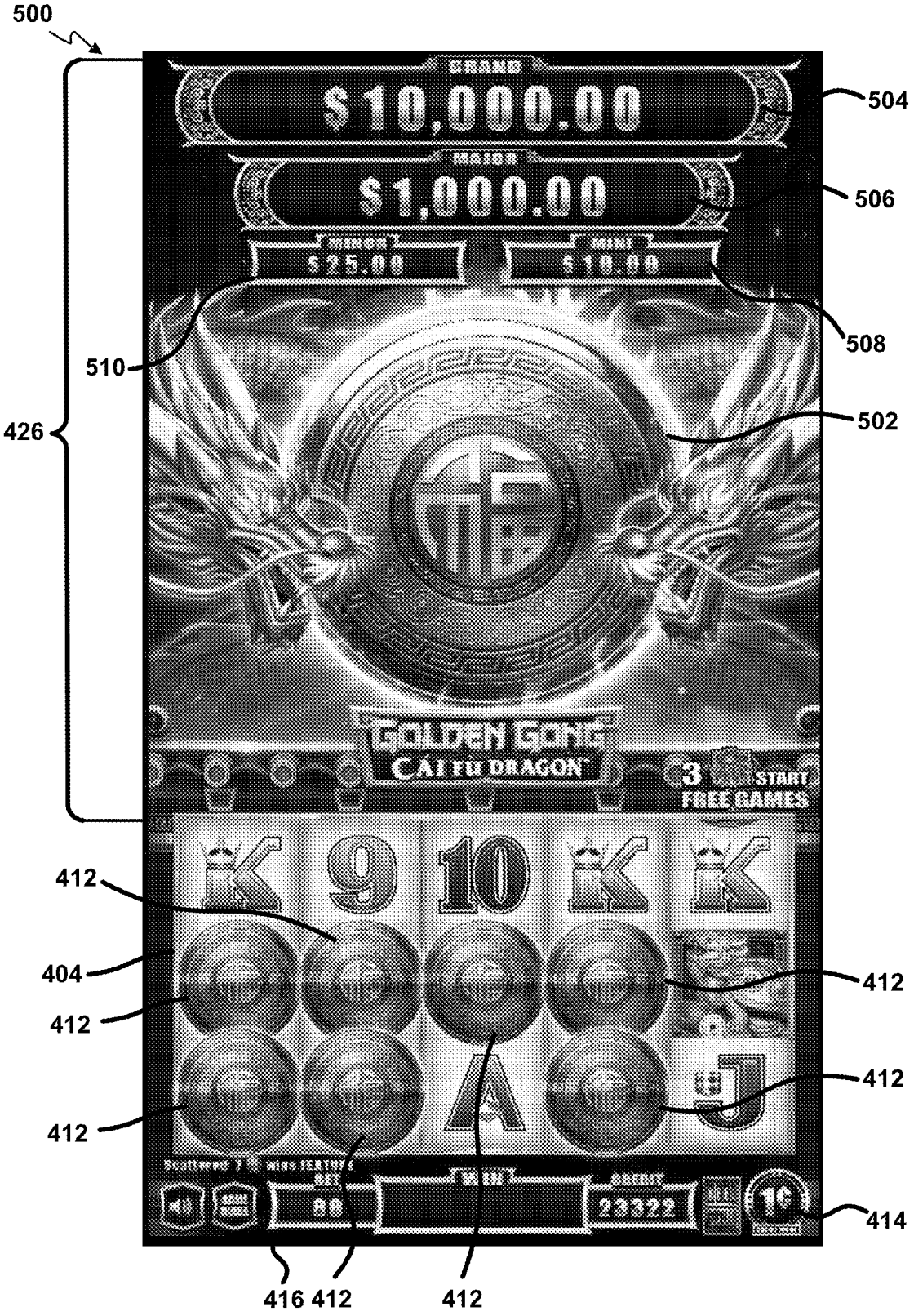
FIG. 5 is an example screenshot of an initial game UI that corresponds to a themed version of the initial game UI.

FIG. 5 is an example screenshot of an initial game UI 500 that corresponds to a themed version of the initial game UI 400 shown in FIG. 4. The initial game UI 500 has a substantially similar UI layout as the initial game UI 400, but with additional graphical elements associated with the game's theme. As shown in FIG. 5 and similar to initial game UI 400, the initial game UI 500 presents a denomination indicator 414 and a bet level indicator 416 underneath the reel area 404. The denomination indicator 414 shows a one cent denomination and the bet level indicator 416 reveals a player's bet level of 88 game credits for the current game play. The reel area 404 for initial game UI 500 also presents 15 symbol positions using a 5×3 reel configuration.

The initial game UI 500 presents a random based game outcome that lands seven credit symbols 412 within the 5×3 reel configuration. In FIG. 5, the credit symbols 412 are shown as golden gong symbols without credit values. Other implementations could have the initial game UI 500 present credit symbols 412 with populated credit values. Having populated credit values may be beneficial for game configurations that determine the initial credit value of the repeat accrual meter based on the credit values of credit symbols 412 used to trigger the supplemental game feature. Although FIG. 5's implementation of initial game UI 500 depicts using credit symbols 412 to satisfy a trigger condition for a supplemental game feature with the repeat accrual meter mechanic, other implementations of the initial game UI 500 could present other trigger conditions for the supplemental game feature. For example, rather than having credit symbols 412 trigger the supplemental game feature, the initial game UI 500 could present other symbol types (e.g., landing 3 scatter symbols) to trigger the supplemental game feature.

The initial game UI 500 also depicts example graphical elements that can be shown within gameplay area 426. Specifically, FIG. 5 illustrates a golden gong based metamorphic 502, a grand jackpot prize indicator 504, major jackpot prize indicator 506, minor jackpot prize indicator 510, and a mini jackpot prize indicator 508. The initial game UI 500 can present state changes of the golden gong based metamorphic 502 based on random based game outcomes shown in reel area 404. The initial game UI 500 may present the state changes using one or more animations. The grand jackpot prize indicator 504, major jackpot prize indicator 506, minor jackpot prize indicator 510, and a mini jackpot prize indicator 508 could present a credit value that can be awarded to a player if a gaming devices satisfies the trigger condition associated with the jackpot prize.

Figure 6:
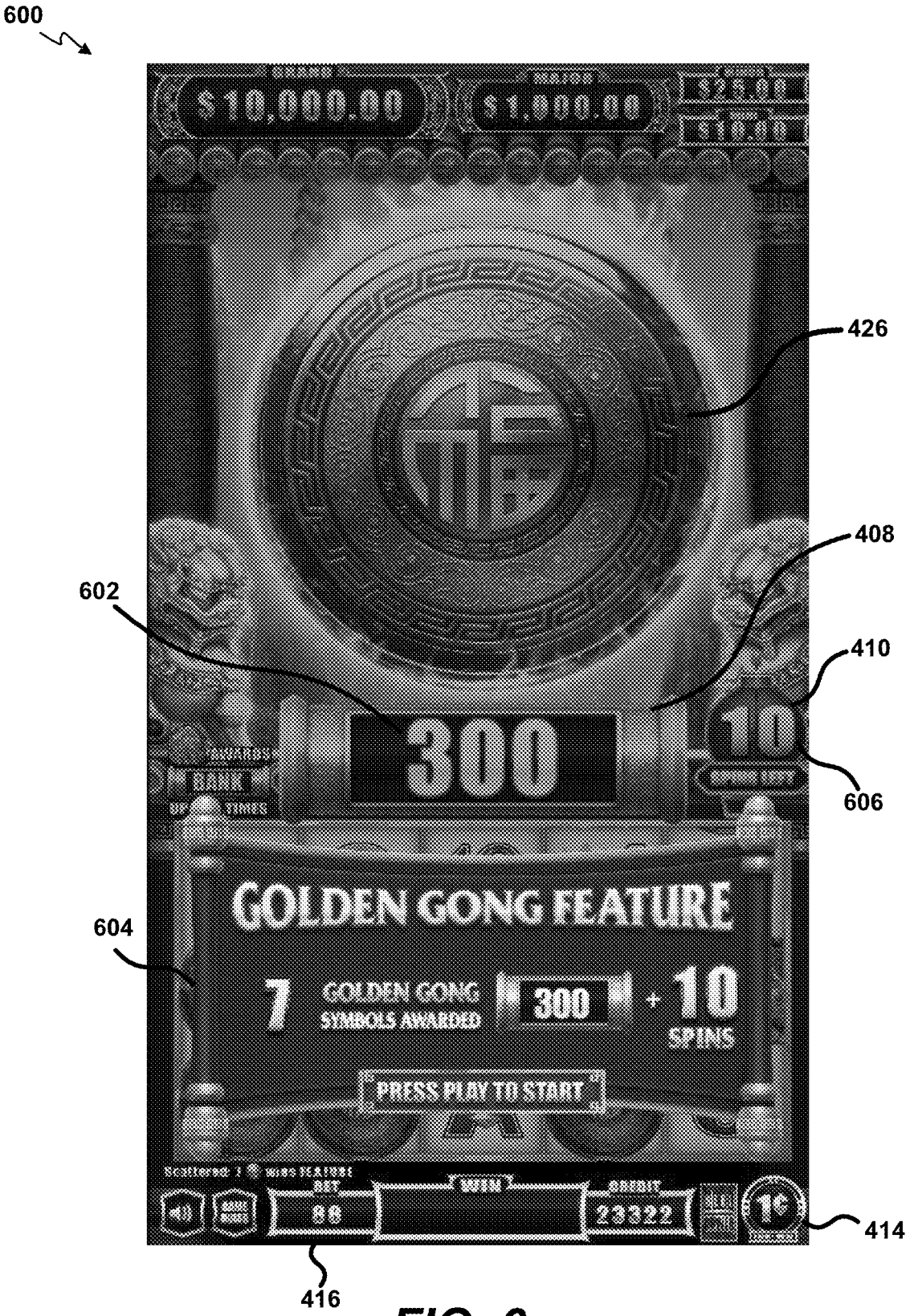
FIG. 6 is an example screenshot of a supplemental game feature UI as a gaming device transitions from the initial game UI shown in FIG. 5 to a supplemental game feature with the repeat accrual meter mechanic.

FIG. 6 is an example screenshot of a supplemental game feature UI 600 as a gaming device transitions from the initial game UI 500 shown in FIG. 5 to a supplemental game feature with the repeat accrual meter mechanic. The supplemental game feature UI 600 corresponds to a themed version of the supplemental game feature UI 402 shown in FIG. 4. Prior to performing the first spin for the supplemental game feature, supplemental game feature UI 600 presents a banner 604 that reveals the game equity a player has currently accrued for the supplemental game feature. For purpose of this disclosure, game equity generally refers to a potential or perceived value that accumulates as a game play progresses. In FIG. 6, banner 604 presents the credit symbol trigger count for the supplemental game feature, the initial credit value 602 of the repeat accrual meter 408 determined from the credit symbol trigger count, and the initial spin count 606 earned for the supplemental game feature. The supplemental game feature UI 600 also shows the initial credit value 602 and the initial spin count 606 within the repeat accrual meter 408 and remaining spin meter 410, respectively.

The supplemental game feature UI 600 displays that by landing seven credit symbols 412 (shown as golden gong symbols in FIG. 5) the initial credit value 602 is 300 game credits. Recall that a gaming device can determine the initial credit value 602 based on the credit symbol trigger count and a player's bet multiplier. Using FIG. 6 as an example, for a gaming device that require a player to wager 88 game credits to activate all reels, the player's bet multiplier would be one since the bet level indicator 416 shows that the player's bet level is 88 game credits. In one or more implementations, the gaming device may also provide other bet multiplier options that allow a player to wager certain multiples of 88 game credits, such as a ×2, ×3, ×5, and/or a ×10 bet multiplier. Table 2 lists out the different bet configurations based on setting a player's bet multiplier and when a game device requires 88 game credits to activate all reels.

TABLE 2

Example Bet Configuration Table

| Player's Bet Multiplier Values | Wagered Game Credits |
|---|---|
| X1 | 88 |
| X2 | 176 |
| X3 | 264 |
| X5 | 440 |
| X10 | 880 |

According to Table 2, if the bet level indicator 416 presents that the player's bet level is 176 game credits, the initial credit value 602 would be 600 credits since a bet level of 176 game credits corresponds to a bet multiplier value of 2 (e.g., 300 game credits×2=600 game credits). If the bet level indicator 416 presents that the player's bet level is 264 game credits, the initial credit value 602 would be 900 credits since a bet level of 264 game credits corresponds to a bet multiplier value of 3 (e.g., 300 game credits×3=900 game credits). The initial credit value 602 increases in the same manner for the other multiplier values shown in Table 2. By scaling the initial credit value 602 according to a player's bet multiplier value, the potential value and/or game equity for the supplemental game feature appropriately matches the player's wager while maintaining a target RTP.

Figure 7:
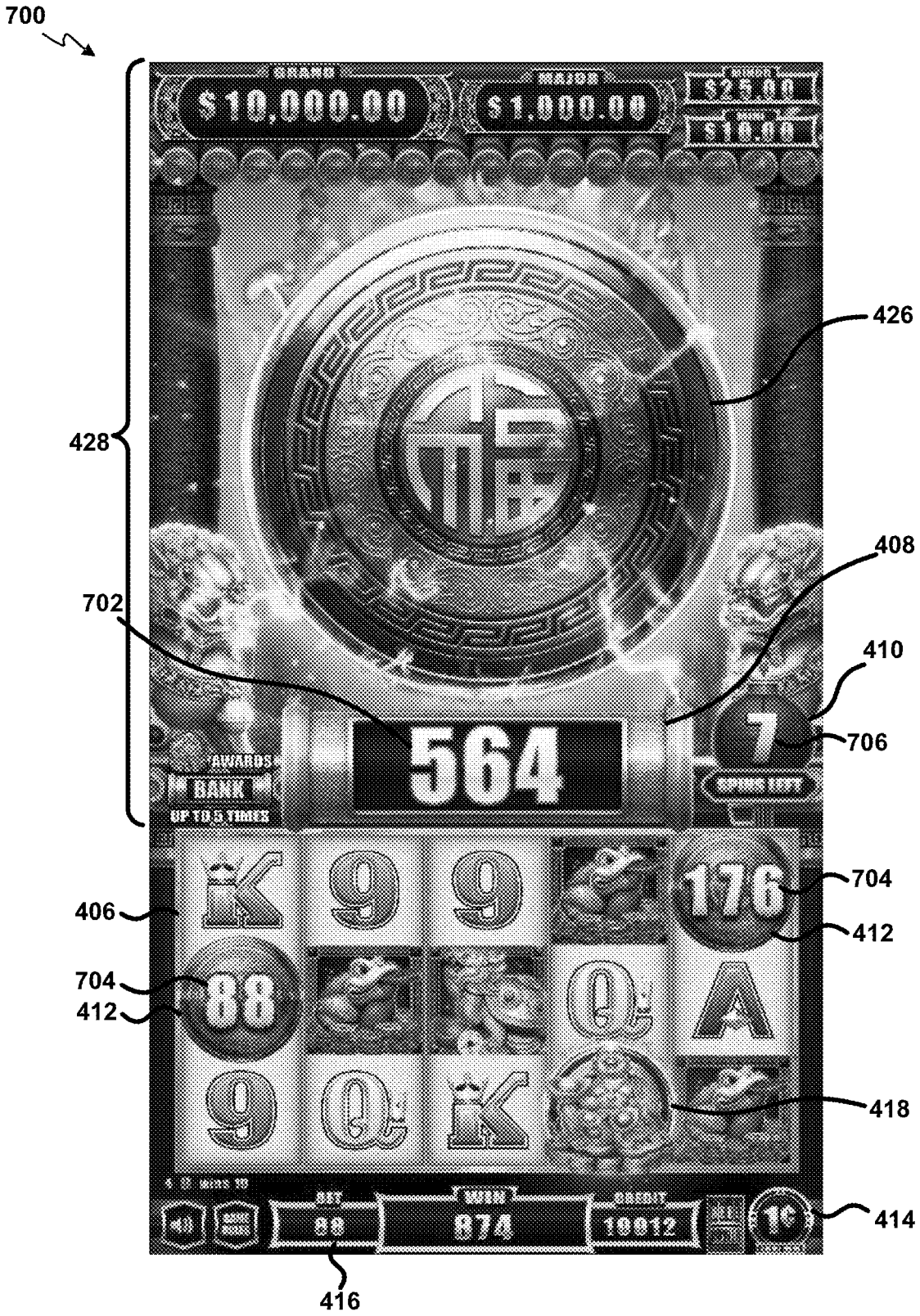
FIG. 7 is another example screenshot of a supplemental game feature UI that depicts a random based game outcome after performing three spins in the supplemental game feature with the repeat accrual meter mechanic.

FIG. 7 is another example screenshot of a supplemental game feature UI 700 that depicts a random based game outcome after performing three spins in the supplemental game feature with the repeat accrual meter mechanic. When comparing the supplemental game feature UI 700 to supplemental game feature UI 600, the accumulated credit value 702 of the repeat accrual meter 408 has increased to 564 game credits and the updated spin count value 706 of the remaining spin meter 410 has decreased to seven remaining spins. The supplemental game feature UI 700 also presents a random based game outcome that produces a target symbol 418 (e.g., wild Buddha symbol) and two credit symbols 412 (e.g., golden gong symbols) that have credit values 704 of 88 game credits and 176 game credits. Recall that the supplemental game feature UI 600 presents a repeat accrual meter 408 with an initial credit value of 300. By landing on the credit symbols 412 with credit values 704, the supplemental game feature UI 700 adds credit values 704 of 88 game credits and 176 game credits to the repeat accrual meter 408 to produce the accumulated credit value 702 of 564 game credits. Afterwards, the accumulated credit value 702 of 564 credits may be awarded to the player according to a meter distribution operation.

In one or more implementations, by using different reel pattern sets and utilizing a unique reel strip to substitute one or more reels shown in the supplemental game feature UI 700, a gaming device can be configured to ensure that at least one of the initial spins allocated to the supplemental game feature will generate a target symbol 418. As previously discussed with reference to FIG. 3, after entering the supplemental game feature, a gaming device can randomly select which spin(s) of the initial spins will use a designated reel pattern set (e.g., reel pattern set B). For the designated reel pattern set (e.g., reel pattern set B), the gaming device ensures that at least one of the reels in designated reel pattern set will be swapped with a unique reel strip. The unique reel strip is setup to guarantee that at least one target symbol 418 will land for a given spin. The gaming device assigns the other spins of the initial spins with one or more other reel pattern sets (e.g., reel pattern set A). To maintain a target RTP, the gaming device can be configured such that other reel pattern sets avoid performing a reel swap with the unique reel strip or is weighted to have relatively low probability of performing the reel swap. In FIG. 7, because the supplemental game feature UI 700 depicts that reel four stops on a target symbol 418 and spin 3 is one of the initial spins, the gaming device could have selected to replace reel four with a unique reel.

Figure 8:
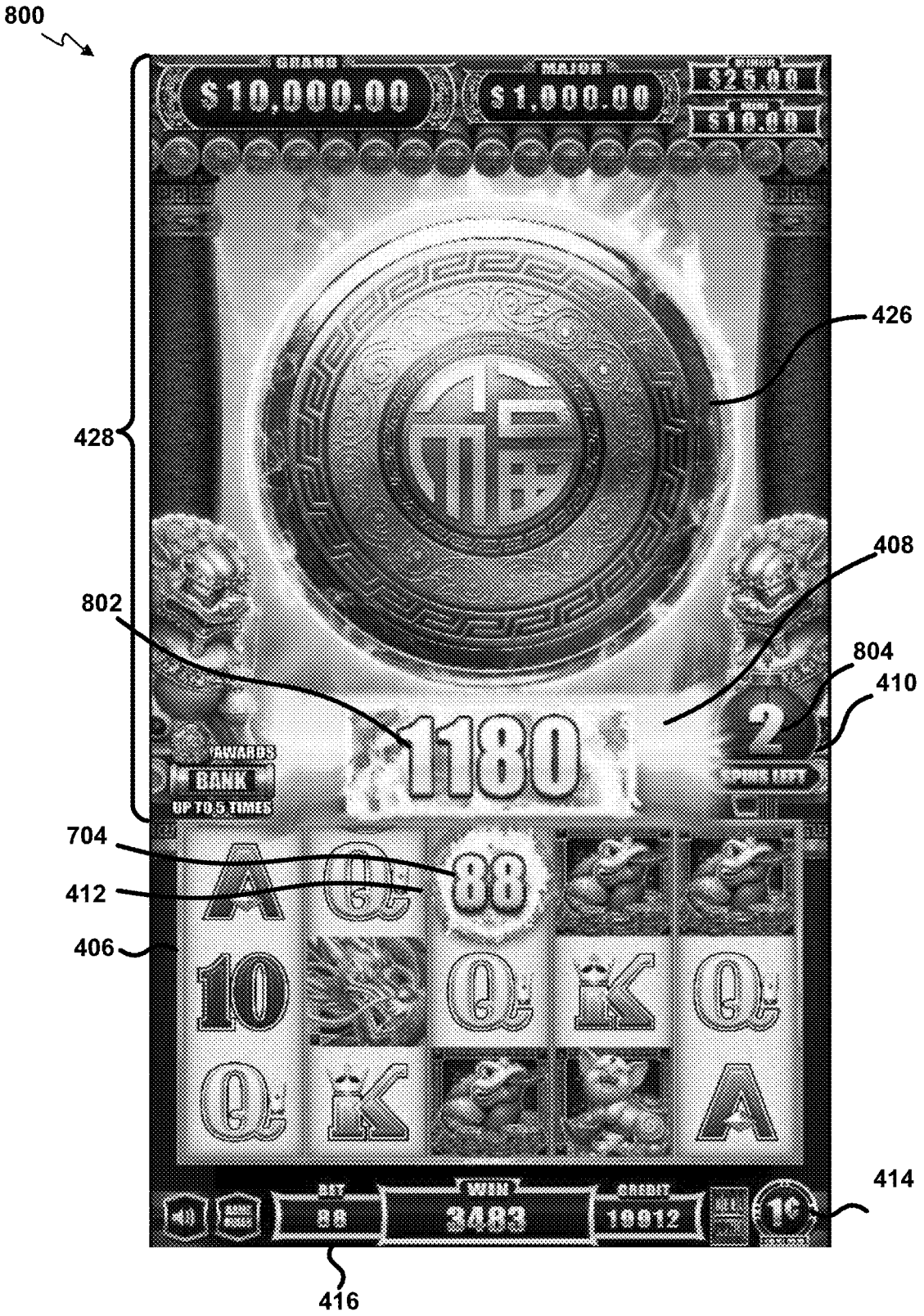
FIG. 8 is another example screenshot of a supplemental game feature UI that depicts a random based game outcome after performing eight spins in a supplemental game feature with the repeat accrual meter mechanic.

FIG. 8 is another example screenshot of a supplemental game feature UI 800 that depicts a random based game outcome after performing eight spins in a supplemental game feature with the repeat accrual meter mechanic. When comparing the supplemental game feature UI 800 to supplemental game feature UI 600 shown in FIG. 6, the accumulated credit value 802 of the repeat accrual meter 408 has increased to 1140 game credits and the updated spin count value 804 of the remaining spin meter 410 has decreased to two spins. The supplemental game feature UI 800 also presents a random based game outcome that produces a credit symbol 412 (e.g., golden gong symbols) with a credit value 704 of 88 game credits. The random based game outcome does not produce a target symbol 418 (e.g., wild Buddha symbol) landing on one of the reels in reel area 406. Although no target symbol 418 lands, the supplemental game feature UI 700 presents that the credit value of 88 game credits is added to the repeat accrual meter 408.

Figure 9:
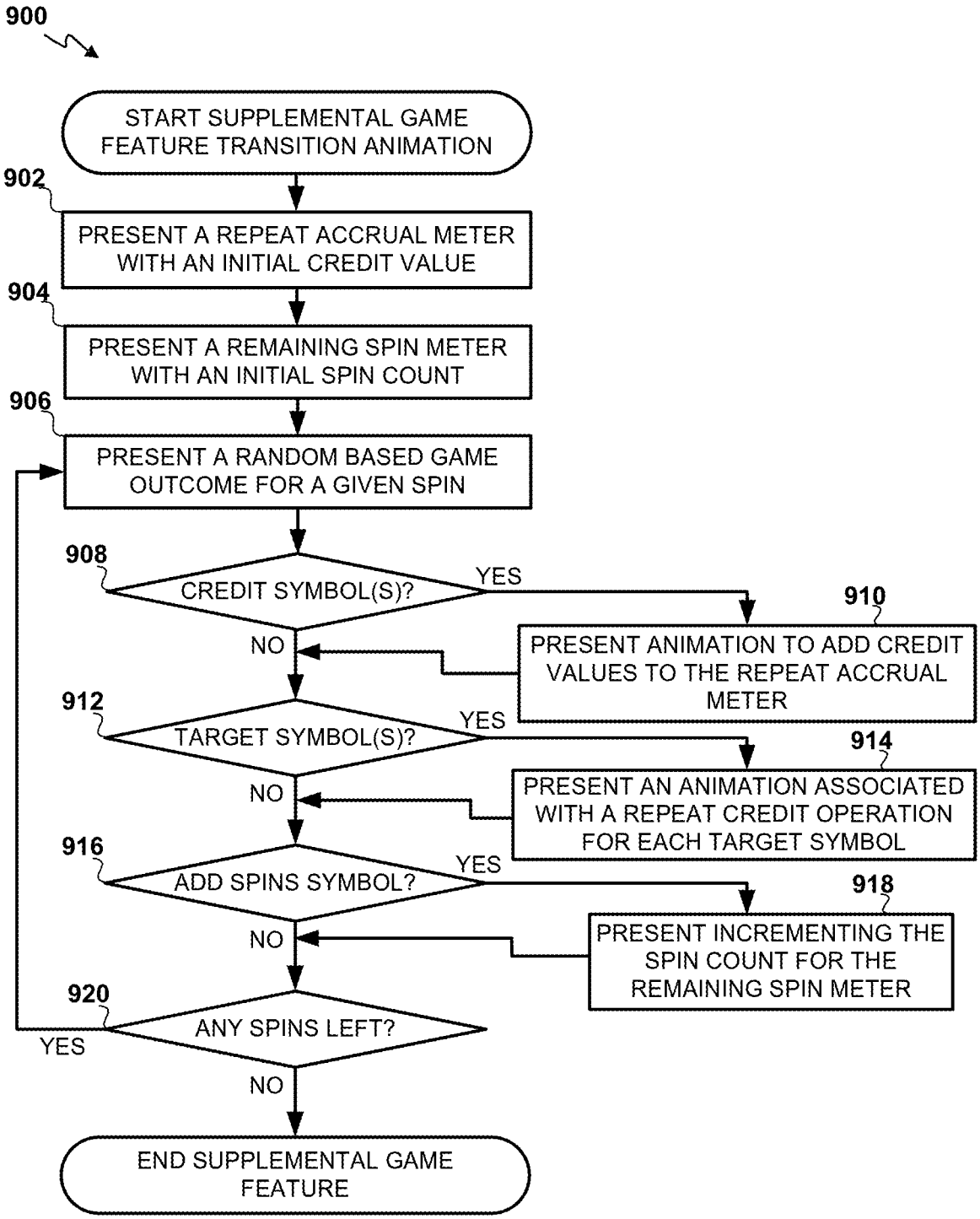
FIG. 9 depicts a flowchart illustrating a UI based operations for presenting a repeat accrual meter mechanic in a supplemental game feature.

FIG. 9 depicts a flowchart illustrating a UI based operations 900 for presenting a repeat accrual meter mechanic in a supplemental game feature. In one implementation, the UI based operation 900 may be implemented by a UI system 302 shown in FIG. 3 and/or displayed on the primary game display 240 and secondary game display 242 of a gaming device 200 shown in FIG. 2A. The UI based operation 900 also corresponds to the supplemental game feature UIs 402, 600, 700, and 800 shown in FIGS. 4-8. The use and discussion of FIG. 9 is only an example to facilitate explanation and is not intended to limit the disclosure to this specific example. For example, UI based operation 900 does not necessarily need to perform the sequence of blocks in the order as depicted in FIG. 9. Specifically, UI based operations 900 may implement blocks 908, 912, and 916 prior to implementing block 906. Additionally, or alternatively, one or more of the blocks may be optional and may not be performed in all implementations of UI based operation 900. As an example, blocks 908, 912, and 916 may be optional and be performed by a backend-based operation, such backend-based operation 1000 shown in FIG. 10.

UI based operation 900 may start at block 902 and present a repeat accrual meter with an initial credit value. Using FIG. 4 as an example, in a reel game, the UI based operation 900 presents the repeat accrual meter 408 in the gameplay area 428 located above the reel area 406. At block 904, the UI based operation 900 presents a remaining spin meter within an initial spin count. Referring to FIG. 4, similar to the repeat accrual meter 408, the remaining spin meter 410 is located above the reel area 406. The repeat accrual meter and/or the remaining spin meter presented in blocks 902 and 904 can represent game equity a player has initially accrued for the supplemental game feature.

After a player initiates gameplay for the supplemental game feature, the UI based operation 900 moves to block 906 and presents a random based game outcome for a given spin. In one implementation, the random based game outcome can be presented as a slot or reel game. Using FIG. 4 as an example again, the UI based operation 900 may present the random based game outcome within a 5×3 reel configuration. To account for utilizing a spin to present the random based game outcome, the UI based operation 900 may also decrement the remaining spin meter by one at block 906. After presenting a random based game outcome, the UI based operation 900 moves to block 908 to determine whether credit symbols exist for the random based game outcome. If credit symbols exist, the UI based operation 900 may move to block 910 and present an animation to add credit values to the repeat accrual meter. Otherwise, UI based operation 900 progresses to block 912.

At block 912, the UI based operation 900 determines whether target symbols exist for the random based game outcome. If the UI based operation 900 determines that a target symbol lands on one of the reels, then UI based operation 900 moves to block 914 and presents an animation associated with a repeat credit operation for each target symbol. For each target symbol, the animation associated with the repeat credit operation may present a meter distribution amount indicating the amount of game credits awarded to a player. Afterwards, the UI based operation 900 moves to block 916 to determine whether an add spins symbol exists for the random based game outcome. If an add spin symbol exists, then UI based operation 900 moves to block 918; otherwise, UI based operation 900 proceeds to block 920. At block 918, the UI based operation 900 presents incrementing the spin count according to the spin value of the add spin symbol. Once completed, the UI based operation 900 moves to block 920. At block 920, the UI based operation 900 determine whether any spins remain for the supplemental game feature. If there are no spins remaining, the UI based operation 900 ends. If there are remaining spins, the UI based operation 900 moves back to block 906.

The UI focused operations described above with reference to FIGS. 4-9 provide technical improvements relating to UI design. Specifically, the supplemental game feature UIs 402, 600, 700, and 800 and UI based operation 900 can improve the usability of the gaming devices, enhance a player's understandability of obtaining certain game outcomes, and provide a new and/or improved UI that presents how a player continuously builds game equity. For example, the supplemental game feature UIs 402, 600, 700, and 800 and UI based operation 900 present changes in a player's game equity, where the game equity continues to increase as the supplemental game feature continues to progress. As the supplemental game feature progresses, the supplemental game feature UIs 402, 600, 700, and 800 and UI based operation 900 present increases in the repeat accrual meter 408. Other implementations of the supplemental game feature UIs 402, 600, 700, and 800 and UI based operation 900, may also alter the state of the metamorphic graphical element according to an occurrence of a certain game outcome or performing a certain operation, such as the repeat credit operation. Stated another way, transitioning the metamorphic graphical element from one to state to another state could represent increases or decreases in a game's perceived or potential value. Other types of game equity, such as the potential or perceive value of the increased likelihood of triggering a relatively high value game event in the future, can also be shown using other graphic elements in supplemental game feature UIs 402, 600, 700, and 800.

In one example, a UI can be configured to present a hold-and-spin mechanic within a reel area. For a given spin in a hold-and-spin mechanic, reels in the reel area of the UI can spin and land on credit symbols and/or other symbol types (e.g., a blank symbol). After a spin completes, the UI holds or locks in place the credit symbols that land on the reels. Other reels that land on other symbols types (e.g., blank symbols) remain unlock. In the next spin, the unlock reels spin and obtain an updated random based game outcome while the locked reels maintain previously locked credit symbols. At the end of the hold-and-spin mechanic, the UI presents a player being awarded the credit values of all the credit symbols that have been locked at the symbol positions in the reel area. As a result, the UI presents the game equity in a hold-and-spin mechanic by locking credit symbols until the end of the feature.

In contrast to presenting a hold-and-spin mechanic, the supplemental game feature UIs 402, 600, 700, and 800 and UI based operation 900 present growth in game equity using the repeat accrual meter through increases in the accumulated credit value. Similar to the hold-and-spin mechanic, the repeat accrual meter mechanic presents growth in game equity when landing on credit symbols. However, instead of locking the credit symbols at their corresponding symbol positions, the supplemental game feature UIs 402, 600, 700, and 800 and UI based operation 900 transfer and add the credit value of each credit symbol to the repeat accrual meter. By doing so, the supplemental game feature UIs 402, 600, 700, and 800 and UI based operation 900 avoid having to lock a symbol position within a reel area while presenting a similar increase in game equity. Moreover, the symbol positions within a reel area remains available to generate additional game outcomes that may be beneficial in further increasing game equity. Having the repeat accrual meter mechanic tied to presenting a target symbol also allows the supplemental game feature UIs 402, 600, 700, and 800 and UI based operation 900 to present multiple opportunities of collecting the accumulated credit value of the repeat accrual meter. Furthermore, with the repeat credit operation, the supplemental game feature UIs 402, 600, 700, and 800 and UI based operation 900 can present a multiplier effect by altering the state of the metamorphic graphical element according to the determined repeat value.

Figure 10:
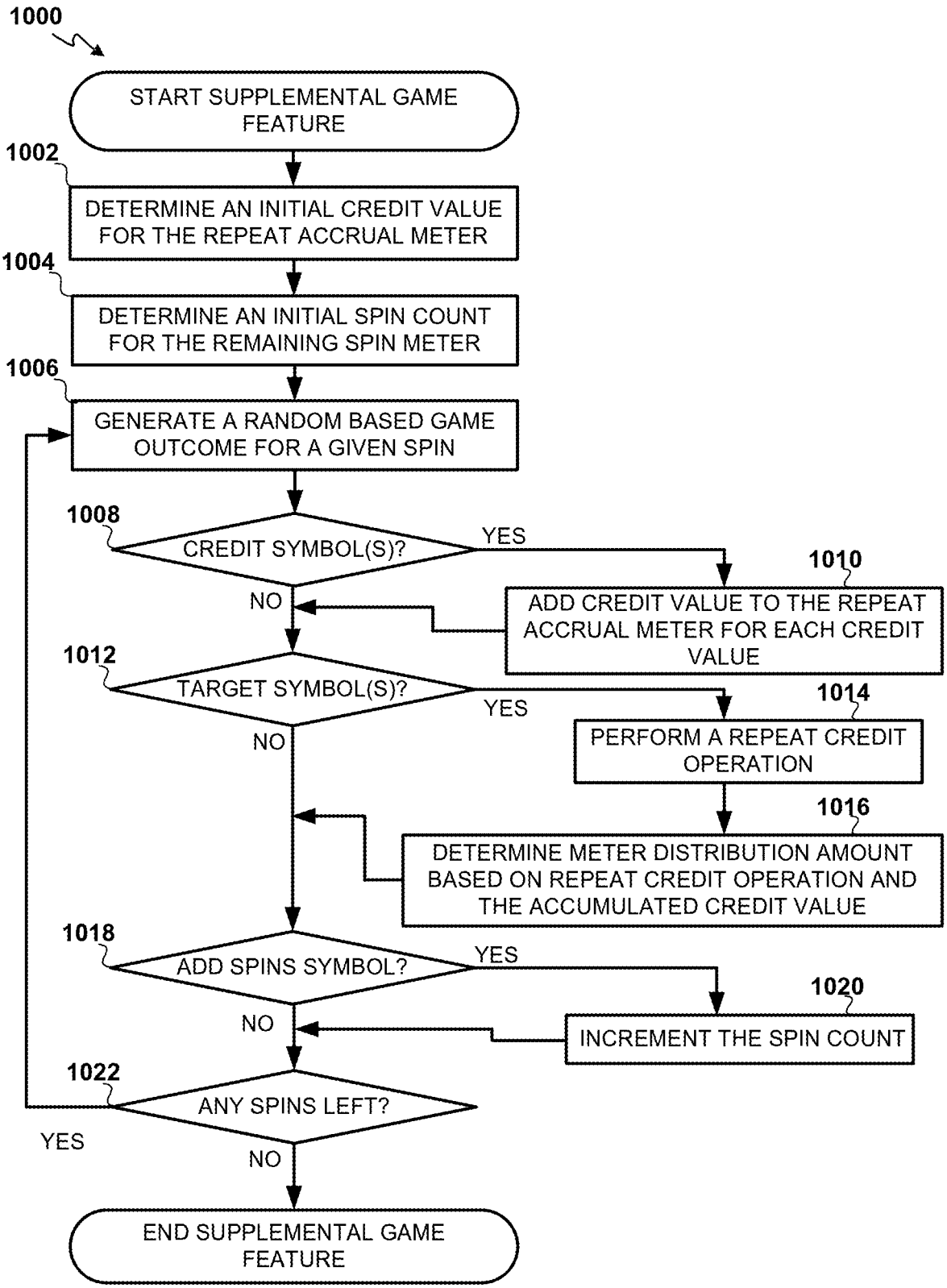
FIG. 10 depicts a flowchart illustrating a backend-based operation for implementing a repeat accrual meter mechanic in a supplemental game feature.

FIG. 10 depicts a flowchart illustrating a backend-based operation 1000 for implementing a repeat accrual meter mechanic. In one or more implementations, backend-based operation 1000 may be implemented by a game processing backend system 314 shown in FIG. 3 and/or by a game controller 202 in FIG. 2A. The backend-based operation 1000 can be implemented in a base game or a supplemental game feature. The use and discussion of FIG. 10 is only an example to facilitate explanation and is not intended to limit the disclosure to this specific example. For example, backend-based operation 1000 does not necessarily need to perform the sequence of blocks in the order as depicted in FIG. 10. As an example, backend-based operation 1000 may implement block 1004 prior to implementing block 1002. Additionally, or alternatively, one or more of the blocks may be optional and may not be performed in all implementations of backend-based operation 1000. Using FIG. 10 as an example, blocks 1018 and 1020 may be optional such that no add spin symbols land during the supplemental game feature.

Backend-based operation 1000 may start at block 1002 and determine an initial credit value for the repeat accrual meter. After triggering the supplement game feature, the backend-based operation 1000 can indirectly determine the initial credit value of the repeat accrual meter. To indirectly determine the initial credit value at block 1002, the backend-based operation 1000 uses a lookup table that maps the credit symbol trigger counts to fixed table values. In one implementation, the fixed table value represents the initial credit value of the repeat accrual meter. In another implementation, the backend-based operation 1000 combines the fixed table value with one or more game parameters to dynamically compute the initial credit value to be displayed in the bonus game play UI 308. As an example, if a gaming device allows a player to select a bet multiplier, then the backend-based operation 1000 multiplies the fixed table value with the player's bet multiplier to determine the initial credit value. For gaming devices that do not offer a bet multiplier option, the backend-based operation 1000 could use a player's bet level along with the fixed table value to determine the initial credit value. Other examples of game parameters that could be used to determine the initial credit value besides using a player's bet multiplier and/or bet level include denomination value, certain symbol types, reel location of certain symbols.

Table 3, which is shown below, provides an example lookup table used for block 1002. Table 3 illustrates that the lookup table maps the credit symbol trigger counts to fixed table values.

TABLE 3

Lookup Table - Credit Symbol Trigger Count to Fixed Table Value

| Credit Symbol Trigger Count | Fixed Table Value |
|---|---|
| 6 | 100 |
| 7 | 200 |
| 8 | 300 |
| 9 | 400 |
| 10 | 500 |
| 11 | 600 |
| 12 | 700 |
| 13 | 800 |
| 14 | 900 |
| 15 | 1000 |

As shown in Table 3, as the credit symbol trigger count increases, the fixed table value increase. Specifically, if the credit symbol trigger count is six, the lookup table returns a fixed table value of 100; if the credit symbol trigger count is seven credit symbols, then lookup table returns a fixed table value of 200 and so forth. By having the fixed table value increase when the credit symbol trigger count increases, the backend-based operation 1000 can maintain a target RTP while including chances of obtaining larger credit amounts.

Other implementations of block 1002 can determine the initial credit value of the repeat accrual meter differently. In one implementation, the backend-based operation 1000 directly determines the initial credit value by adding up all credit values for the credit symbols that triggered the supplemental game feature. For example, if a random based game outcome in a base game generates six credit symbols and the total credit value of all six credit symbols is 1,000 game credits, then backend-based operation 1000 would set the initial credit value to be 1,000 game credits. In other implementations of block 1002, the backend-based operation 1000 can randomly determine the initial credit value based on the credit symbol trigger count and/or other game parameters (e.g., the player's bet multiplier, bet level, and symbol types). Referring to FIG. 3 as an example, to randomly determine the initial credit value, the backend-based operation 1000 receives an RNG call from a UI system 302. Using a gaming RNG 318 and the RNG conversion engine 320, backend-based operation 1000 generates an RNG outcome and performs a lookup from a set of lookup tables 322 based on the RNG outcome. Each lookup table 322 in the set of lookup tables maps a designated credit symbol trigger count to a range of table values.

Tables 4 and 5, which are shown below, provide examples of lookup tables for randomly determining the initial credit values.

TABLE 4

Example Lookup Table for a Credit Symbol Trigger Count of Six

| Count Value | Table Value Entry |
|---|---|
| 20 | 100 |
| 15 | 200 |
| 10 | 300 |
| 5 | 400 |

TABLE 5

| Example Lookup Table for a Credit Symbol Trigger Count of Seven | |
|---|---|
| Count Value | Table Value Entry |
| 20 | 200 |
| 15 | 300 |
| 10 | 400 |
| 5 | 500 |

The different ranges of table values between Table 4 and 5 are based on the credit symbol trigger count. Specifically, Table 4 corresponds to a lookup table for when the credit symbol trigger count is six with a range of table values from 100-400. Table 5 corresponds to a lookup table when the credit symbol trigger count is seven with a range of table values from 200-500. The set of lookup tables would include other similar lookup tables for other credit symbol trigger counts. As shown in Tables 4 and 5, to maintain a target RTP, the backend-based operation 1000 is more likely to return a lower table value than higher table values. In another example, rather than using a set of lookup tables, the backend-based operation 1000 could utilize a single lookup table that maps all designated credit symbol trigger counts to one or more table value ranges. The backend-based operation 1000 can use the table value as the initial credit value of the repeat accrual meter or combine the table value with one or more game parameters, such as the player's bet multiplier, to determine the initial credit value.

From block 1002, backend-based operation 1000 may move to block 1004 to determine an initial spin count for the remaining spin meter. Similar to how backend-based operation 1000 determined an initial credit value of the repeat accrual meter, the backend-based operation 1000 can determine the initial spin count by performing lookups on lookup tables that return fixed table values or varying table values for a given credit symbol trigger count. In other words, the lookup tables for block 1004 would have similar to the lookup tables for block 1002 except that entered table values would correspond to initial spin counts rather than initial credit values. Specifically, the fixed or varying table values could represent the initial spins allocated for the supplemental game feature or be values that are combined with one or more game parameters to derive the initial number of spins.

After completing block 1004, backend-based operation 1000 may continue to block 1006 to generate a random based game outcome for a given spin. In one or more implementations, at block 1006, backend-based operation 1000 may dynamically populate one or more reel strips in order to generate the random based game outcome. An example of dynamically populating the reel strips is shown and discussed with reference to FIG. 11. After populating the reel strips, the backend-based operation 1000 performs one or more RNG pulls depending on the number of reels. As an example, if the supplemental game feature includes five reels, the backend-based operation 1000 performs a total of five RNG pulls, one RNG pull for each reel strip, to determine the reel stops for each reel strip; thereby, generating the random based game outcome.

After backend-based operation 1000 generates the random based game outcome, the backend-based operation 1000 proceeds to block 1008 to determine whether the random based game outcome includes credit symbols. If backend-based operation 1000 determines credit symbols have landed on the reels, then backend-based operation 1000 moves to block 1010. Otherwise, backend-based operation 1000 moves to block 1012. At block 1010, the backend-based operation 1000 adds the credit values of all credit symbols that land to the repeat accrual meter to generate an accumulated credit value of the repeat accrual meter.

At block 1012, backend-based operation 1000 determines whether one or more target symbols land based on the random based game outcome generated in block 1006. If one or more target symbols land, the backend-based operation 1000 moves to block 1014. If no target symbols land, then backend-based operation 1000 proceeds to block 1018. At block 1014, backend-based operation 1000 performs a repeat credit operation that determines a repeat value. To determine a repeat value, the backend-based operation 1000 performs an RNG pull for one or more lookup tables 322 that maps the RNG outcome to the repeat value. As an example, the game processing backend system 314 can include a single lookup table 322 that returns the repeat value. In another example where backend-based operation 1000 uses multiple reel pattern sets (e.g., reel pattern set A and reel pattern set B), a separate lookup table can correspond to each reel pattern set. Having a lookup table to determine the repeat value for each reel pattern provides more flexibility on controlling and managing RTP. Tables 6 and 7 provide examples of lookup tables that return the repeat value based on reel pattern set A and reel pattern set B, respectively.

TABLE 6

| Example Lookup Table for Reel Pattern Set A | |
|---|---|
| Count Value | Repeat Value Entry |
| 20 | 5 |
| 15 | 4 |
| 10 | 3 |
| 5 | 2 |
| 3 | 1 |

TABLE 7

| Example Lookup Table for Reel Pattern Set B | |
|---|---|
| Count Value | Repeat Value Entry |
| 20 | 5 |
| 12 | 4 |
| 10 | 3 |
| 3 | 2 |
| 3 | 1 |

As shown in Tables 6 and 7, the backend-based operation 1000 is more likely to return higher repeat values, such 3, 4, and 5 than repeat values 1 and 2. Depending on the credit values of the credit symbol and the determined rate that a target symbol lands on a reel, the weights (shown as "count values") can be adjusted accordingly to achieve a target RTP.

From block 1014, backend-based operation 1000 can move to block 1016 to determine a meter distribution amount to credit to a player. At block 1016, the backend-based operation 1000 determines the meter distribution amount based on the repeat credit operation performed in block 1014 and the accumulated credit value of the repeat accrual meter. After completing block 1016, backend-based operation 1000 moves to block 1018 to determine whether the random based game outcome includes at least one add spins symbol. If there is at least one add spins symbol, backend-based operation 1000 continues to block 1020 and increments the spin count for the remaining spin meter according to the spin value of the add spins symbol. Backend-based operation 1000 then moves to block 1022 to determine whether any remaining spins are left for the supplemental game feature. If no spins remain, then the backend-based operation 1000 ends. Alternatively, if there are any spins that remain, backend-based operation 1000 returns to block 1006.

Figure 11:
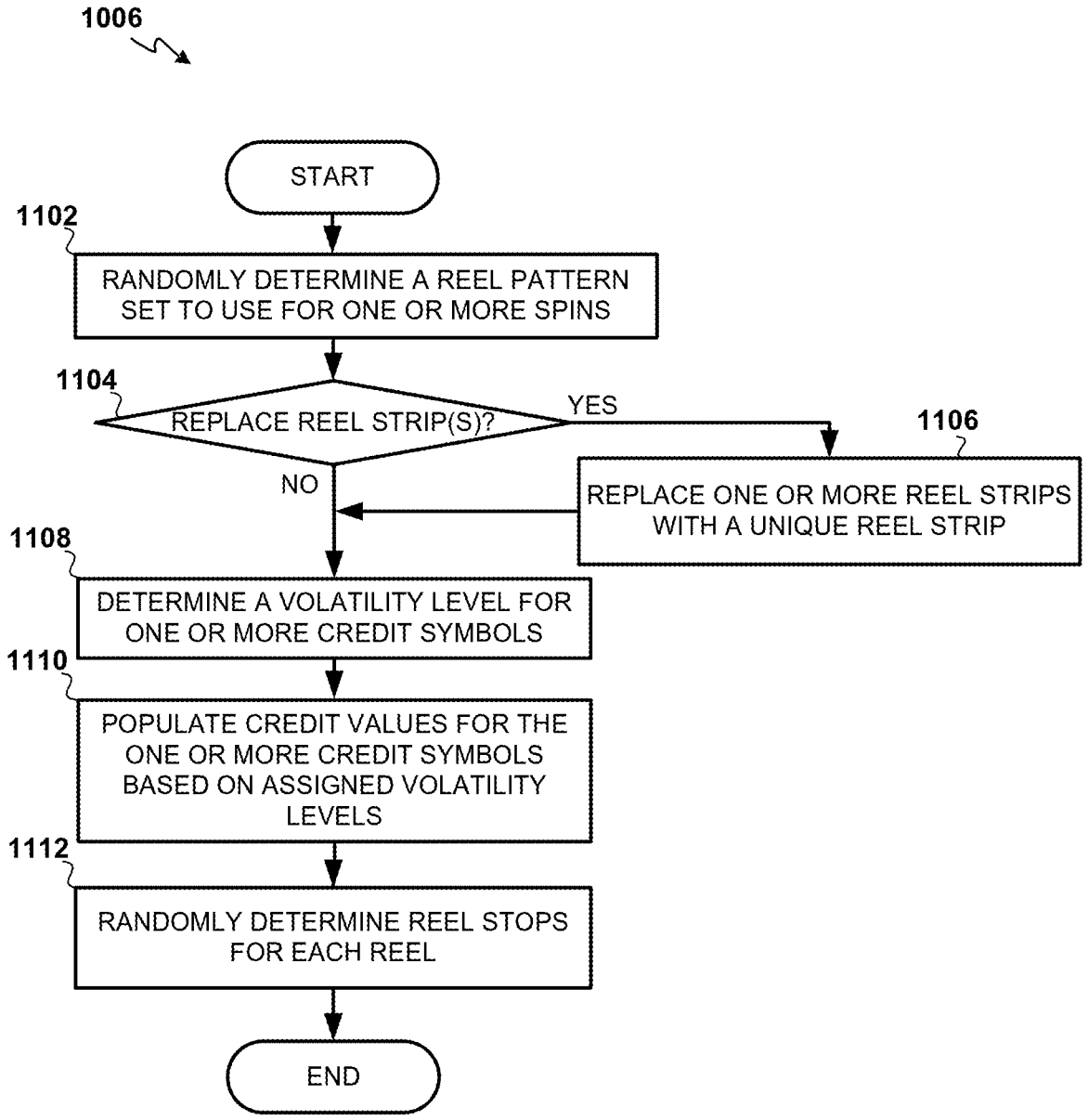
FIG. 11 depicts a flowchart illustrating an implementation of generating random based game outcome as shown in FIG. 10.

FIG. 11 depicts a flowchart illustrating an implementation of block 1006 shown in FIG. 10. In one or more implementations, prior to generating a random based game outcome for block 1006, backend-based operation 1000 populates one or more reel strips to ensure that at least one of the initial spins allocated to the supplemental game feature will generate a target symbol. To do so, backend-based operation 1000 can randomly select which spin(s) of the initial spins will use a designated reel pattern set (e.g., reel pattern set B). For the designated reel pattern set (e.g., reel pattern set B), backend-based operation 1000 ensures that at least one of the reels in designated reel pattern set will be swapped with a unique reel strip. The unique reel strip is setup to guarantee that at least one target symbol will land for a given spin. The backend-based operation 1000 assigns the other spins of the initial spins with one or more other reel pattern sets (e.g., reel pattern set A). The backend-based operation 1000 avoids performing a reel swap with the unique reel strip or is weighted to have relatively low probability of performing the reel swap for the other reel pattern sets.

As previously mentioned for FIGS. 9 and 10, the use and discussion of flowcharts shown in this disclosure, such as FIG. 11, are only examples to facilitate explanation and is not intended to limit the disclosure to this specific example. As an example, backend-based operation 1000 does not necessarily need to perform the sequence of blocks in the order as depicted in FIG. 11. Additionally, or alternatively, one or more of the blocks may be optional and may not be performed in all implementations of backend-based operation 1000.

As shown in FIG. 11, to perform block 1006, backend-based operation 1000 starts at block 1102 to randomly determine a reel pattern set to use for a given spin. A reel pattern set corresponds to the reel patterns selected for the set of reels. Referring to FIG. 4 as an example, the supplemental game feature UI 402 presents five different reels, reels 1-5. A reel pattern set provides the symbol pattern for all five of the reel strips. At block 1102, backend-based operation 1000 could have multiple reel pattern sets to populate the five reel strips, such as "reel pattern set A" and "reel pattern set B." The two different reel pattern sets could have the same symbol patterns for all reel strips but with different weights. Alternatively, the two different reel pattern sets could have different symbol patterns with different weights for at least one reel strip.

In one or more implementations, backend-based operation 1000 could select a reel pattern set for multiple spins. Specifically, the backend-based operation 1000 can randomly select which spin(s) out of a set of spins will utilize a specified reel pattern set. Recall that the backend-based operation 1000 determines an initial number of spins for the supplemental game feature in block 1004. Based on the initial spin count, backend-based operation 1000 can randomly select which of the initial spin(s) (e.g., spin 2 out of the 5 initial spins) will use a specified reel pattern set (e.g., reel pattern set B). Table 8 provides an example of a lookup table that randomly selects which spin of the initial spins awarded for supplemental game feature will utilize the specified reel pattern set B.

TABLE 8

Example Lookup Table for Selecting Reel Pattern Set B

| Count Value | Spin Entry |
|---|---|
| 200 | 1 |
| 150 | 2 |
| 100 | 3 |
| 50 | 4 |
| 30 | 5 |

As shown in Table 8, the earlier spins, such as spins 1-3, are weighted more so that backend-based operation 1000 is more likely to select reel pattern set B than later spins. Weighting the earlier spins to select reel pattern set B may be beneficial if reel pattern set B includes a larger number of target symbols or is set up to guarantee landing a target symbol for a given spin. The other remaining spins that backend-based operation 1000 does not select for reel pattern set B may be designated for other reel pattern sets (e.g., reel pattern set A). Although Table 8 illustrates selecting one spin for a given reel pattern set (e.g., reel pattern set B), other implementations of the lookup table could return multiple spins for the reel pattern set.

In one or more implementations, backend-based operation 1000 may select a reel pattern for a single spin using a lookup table. The backend-based operation 1000 may utilize a lookup table, for example Table 9, for spins that occur after the initial spins awarded for triggering the supplemental game feature. Table 9 provides an example of lookup table that randomly selects whether backend-based operation 1000 uses reel pattern set A or reel pattern set B for a given spin.

TABLE 9

Example Lookup Table for Selecting Reel Patterns

| Count Value | Spin Count Entry |
|---|---|
| 100 | Reel pattern set A |
| 3 | Reel pattern set B |

Based on Table 9, a backend-based operation 1000 is less likely to select reel pattern set B. Backend-based operation 1000 may select reel pattern set B less often since reel pattern set B may provide a larger payout by having more target symbols or guaranteeing to land a target symbol for a given spin.

After completing block 1102, backend-based operation 1000 may move to block 1104 and determine whether to replace one or more reel strips for the selected reel pattern set. If backend-based operation 1000 determines that a reel strip needs to be replaced, backend-based operation 1000 moves to block 1106 to replace one or more reel strips with a unique reel strip. In one or more implementations, the unique reel strip could include more target symbols or be setup to guarantee one or more target symbols to land for a given spin. Alternatively, if the backend-based operation 1000 determines that a reel strips does not need to be replaced, backend-based operation 1000 moves to block 1108.

Returning to block 1104, backend-based operation 1000 can use one or more lookup tables to determine which reels for a given reel pattern set should be substituted for a unique reel strip. Tables 10 and 11 provide example lookup tables for determining which reels should be substituted with a unique reel strip for reel pattern set A and reel pattern set B, respectively. As shown in Table 10, reel pattern set A is weighted such that no reel strips are substituted to the unique reel strip. For Table 11, reel pattern set B is weighted such that at least one of the reel strips will be substituted with a unique reel strip. Specifically, Table 11 illustrates that reels 2, 3, or 4 are more likely to be individually replaced with the unique reel than having multiple reels strips replaced (e.g., reels 3 and 4) for a given spin.

TABLE 10

Example Lookup Table for Reel Pattern Set A

| Count Value | Reel Value Entry |
|---|---|
| 1 | 0 |
| 0 | 2 |
| 0 | 3 |
| 0 | 4 |
| 0 | 3, 4 |

TABLE 11

Example Lookup Table for Reel Pattern Set B

| Count Value | Reel Value Entry |
|---|---|
| 0 | 0 |
| 14 | 2 |
| 13 | 3 |
| 12 | 4 |
| 1 | 3, 4 |

At block 1108, backend-based operation 1000 can dynamically populate at least one reel strip by randomly selecting a volatility level. As an example, for a given spin, each reel strip in a set of reels (e.g., reels 1-5) could include one or more credit symbols that the backend-based operation 1000 can dynamically adjust their corresponding credit values. To dynamically adjust the credit values for each credit symbol, backend-based operation 1000 performs an RNG pull from a volatility lookup table that maps an RNG outcome to a certain volatility. Table 12 provides an example volatility lookup table that assigns low, medium, or high volatility for a credit symbol. As shown in Table 12, to maintain a target RTP, backend-based operation 1000 is more likely to select low volatility than compared to medium or high volatility.

TABLE 12

Example Volatility Lookup Table

| Count Value | Volatility Entry |
|---|---|
| 100 | Low |
| 50 | Medium |
| 1 | High |

After completing block 1108, the backend-based operation 1000 moves to block 1110 and populates a credit value for the credit symbols based on the assigned volatility. To populate the credit value, the backend-based operation 1000 may perform an RNG pull from a designated lookup table that includes a range of credit values. The backend-based operation 1000 may select the designated lookup table from a set of lookup tables, where each lookup table is specific to the denomination value, player's bet level, and/or the assigned volatility of a credit symbol. For example, one lookup table could correspond to when the supplemental game feature is triggered using a one cent denomination, a player's bet level of 88 game credits, and an assigned medium volatility. By having multiple lookup tables, the credit value ranges for each lookup table could be customized or setup to vary according to the different game parameters. From block 1110, the backend-based operation 1000 then moves to block 1112 to randomly determine reel stops for each populated reel.

Alternatives and Variations

Numerous embodiments are described in this disclosure and are presented for illustrative purposes only. The described embodiments are not, and are not intended to be, limiting in any sense. As an example, although the disclosure generally describes the repeat accrual meter mechanic in a Class III reel or slot game context the disclosure is not limited to this type of game and/or gaming device. For example, other implementations and/or portions of the repeat accrual meter mechanic may be implemented as a Class II gaming device. In particular, a gaming device may present UIs, such as supplemental game feature UIs 402, 600, 700, and 800, while implementing a Class II bingo game. Additionally, or alternatively, portions of the repeat accrual meter mechanic can be utilized for other types of wagering games, such as keno, lottery, and pachinko.

The present disclosure is widely applicable to numerous embodiments, as is readily apparent from the disclosure. One of ordinary skill in the art will recognize that the innovations described herein may be practiced with various modifications and alterations, such as structural, logical, software, and electrical modifications. Although particular features of the innovations described herein may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the innovations described herein that must be present in all embodiments.

The Title (set forth at the beginning of the first page of this disclosure) is not to be taken as limiting in any way as the scope of the disclosed embodiments. Headings of sections provided in this disclosure are for convenience only and are not to be taken as limiting the disclosure in any way.

When an ordinal number (such as "first," "second," "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget." Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget"" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When introducing elements of aspects of the present disclosure or embodiments thereof, the articles "a," "an," "the," and "said" are intended to mean that there are one or more of the elements. The terms "comprising," including," and "having" are intended to be inclusive and mean that there may be additional elements other than the listed elements.

When a single device, component, structure, or article is described herein, more than one device, component, structure or article (whether or not they cooperate) may alternatively be used in place of the single device, component or article that is described. Accordingly, the functionality that is described as being possessed by a device may alternatively be possessed by more than one device, component or article (whether or not they cooperate).

Similarly, where more than one device, component, structure, or article is described herein (whether or not they cooperate), a single device, component, structure, or article may alternatively be used in place of the more than one device, component, structure, or article that is described. For example, a plurality of computer-based devices may be substituted with a single computer-based device. Accordingly, the various functionality that is described as being possessed by more than one device, component, structure, or article may alternatively be possessed by a single device, component, structure, or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Further, the systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

Devices that are in communication with each other need not be in continuous communication with each other, unless expressly specified otherwise. On the contrary, such devices need only transmit to each other as necessary or desirable and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the innovations described herein. Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the innovations described herein, and does not imply that the illustrated process is preferred.

Although a process may be described as including a plurality of steps, that does not indicate that all or even any of the steps are essential or required. Various other embodiments within the scope of the present disclosure include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the present disclosure include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise.

For the sake of presentation, the detailed description uses terms like "determine" and "select" to describe computer operations in a computer system. These terms denote operations performed by a computer and should not be confused with acts performed by a human being. The actual computer operations corresponding to these terms vary depending on implementation. For example, "determining" something can be performed in a variety of manners, and therefore the term "determining" (and like terms) can indicate calculating, computing, deriving, looking up (e.g., in a table, database or data structure), ascertaining, recognizing, and the like.

As used herein, the term "send" denotes any way of conveying information from one component to another component, and the term "receive" denotes any way of getting information at one component from another component. The two components can be part of the same computer system or different computer systems. The information can be passed by value (e.g., as a parameter of a message or function call) or passed by reference (e.g., in a buffer). Depending on context, the information can be communicated directly between the two components or be conveyed through one or more intermediate components. As used herein, the term "connected" denotes an operable communication link between two components, which can be part of the same computer system or different computer systems. The operable communication link can be a wired or wireless network connection, which can be direct or pass through one or more intermediate components (e.g., of a network). Communication among computers and devices may be encrypted to ensure privacy and prevent fraud in any of a variety of ways well known in the art.

It will be readily apparent that the various methods and algorithms described herein may be implemented by, e.g., appropriately programmed general-purpose computers and computing devices. Typically, a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software. Accordingly, a description of a process likewise describes at least one apparatus for performing the process, and likewise describes at least one computer-readable medium for performing the process. The apparatus that performs the process can include components and devices (e.g., a processor, input and output devices) appropriate to perform the process. A computer-readable medium can store program elements appropriate to perform the method.

The term "computer-readable medium" refers to any non-transitory storage or memory that may store computer-executable instructions or other data in a computer system and be read by a processor in the computer system. A computer-readable medium may take many forms, including but not limited to non-volatile storage or memory (such as optical or magnetic disk media, a solid-state drive, a flash drive, PROM, EPROM, and other persistent memory) and volatile memory (such as DRAM). The term "computer-readable media" excludes signals, waves, and wave forms or other intangible or transitory media that may nevertheless be readable by a computer.

The present disclosure provides, to one of ordinary skill in the art, an enabling description of several embodiments and/or innovations. Some of these embodiments and/or innovations may not be claimed in the present application but may nevertheless be claimed in one or more continuing applications that claim the benefit of priority of the present application. Applicants may file additional applications to pursue patents for subject matter that has been disclosed and enabled but not claimed in the present application.

The foregoing description discloses only exemplary embodiments of the present disclosure. Modifications of the above disclosed apparatus and methods which fall within the scope of the present disclosure will be readily apparent to those of ordinary skill in the art. For example, although the examples discussed above are illustrated for a gaming market, embodiments of the present disclosure can be implemented for other markets. The gaming system environment of the examples is not intended to suggest any limitation as to the scope of use or functionality of any aspect of the disclosure.

While the invention has been described with respect to the figures, it will be appreciated that many modifications and changes may be made by those skilled in the art without departing from the spirit of the invention. Any variation and derivation from the above description and figures are included in the scope of the present invention as defined by the claims. In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A non-transitory computer-readable medium, readable by at least one processor and comprising instructions stored thereon to cause the at least one processor to:

determine an initial credit value for a repeat accrual meter prior to a given spin;

randomly select a reel pattern set, from a plurality of reel pattern sets, to configure a set of reels for one or more spins to ensure that at least one target symbol lands in the one or more spins, the one or more spins including the given spin;

output the initial credit value in a first portion of a display;

output the randomly selected reel pattern set in a second portion of the display, wherein the first portion of the display and the second portion of the display are non-overlapping;

generate, using the set of reels configured according to the reel pattern set for the spin, a random based game outcome for the given spin, wherein the random based game outcome includes having a credit symbol and a given target symbol of the at least one target symbol;

determine an accumulated credit value for the repeat accrual meter based on adding a credit value of the credit symbol to the initial credit value;

randomly determine a repeat value by triggering a repeat credit operation based on the given target symbol from the generated random based game outcome and the randomly selected reel pattern set, wherein the repeat value is indicative of a number of times to credit the accumulated credit value;

determine a total credit value based on the accumulated credit value and the repeat value;

present one or more first animations in a third portion of the display to decrement a remaining spin count and present one or more second animations in the first portion of the display to update the initial credit value to the determined total credit value.

2. The non-transitory computer-readable medium of claim 1, wherein the instructions to determine the initial credit value for the repeat accrual meter prior to the given spin further comprises instructions that cause the at least one processor to perform a lookup on a lookup table that maps a credit symbol trigger count to a table value, and wherein the credit symbol trigger count is indicative of a number of credit symbols used to trigger a supplemental game feature with the repeat accrual meter.

3. The non-transitory computer-readable medium of claim 2, wherein the instructions further cause the at least one processor to combine the table value to one or more game parameters to determine the initial credit value.

4. The non-transitory computer-readable medium of claim 2, wherein the table value represents the initial credit value.

5. The non-transitory computer-readable medium of claim 2, wherein the lookup table includes a range of table values for the credit symbol trigger count.

6. The non-transitory computer-readable medium of claim 1, wherein the instructions further cause the at least one processor to determine an initial spin count based on a credit symbol trigger count, wherein the credit symbol trigger count is indicative of a number of credit symbols used to trigger a supplemental game feature with the repeat accrual meter.

7. The non-transitory computer-readable medium of claim 6, wherein the given spin corresponds to a spin that is part of the initial spin count, and wherein the given target symbol is guaranteed to appear for the random based game outcome based on the given spin being part of the initial spin count.

8. The non-transitory computer-readable medium of claim 1, wherein the instructions further cause the at least one processor to, as part of configuring the set of reels for the one or more spins, determine whether to replace one or more reel strips of the set of reels, for the reel pattern set, based on a random number generator pull on a lookup table.

9. The non-transitory computer-readable medium of claim 8, wherein the lookup table maps a random number to the one or more reel strips.

10. The non-transitory computer-readable medium of claim 8, wherein the lookup table maps a random number to a given spin count.

11. The non-transitory computer-readable medium of claim 1, wherein the instructions further cause the at least one processor to, as part of configuring the set of reels for the one or more spins, replace the one or more reel strips of the set of reels, for the reel pattern set, with a unique reel strip, wherein the unique reel strip is constructed to guarantee landing on the at least one target symbol for the given spin.

12. The non-transitory computer-readable medium of claim 1, wherein the instructions further cause the at least one processor to, as part of configuring the set of reels for the one or more spins:

determine a volatility level for the credit symbol; and in a reel strip of the set of reels, populate the credit value of the credit symbol based on the volatility level.

13. The non-transitory computer-readable medium of claim 12, wherein the instructions to populate the credit value of the credit symbol comprises instructions that cause the at least one processor to populate the credit value of the credit symbol further based on a player's bet level and a denomination value.

14. The non-transitory computer-readable medium of claim 1, wherein the instructions to determine the initial credit value for the repeat accrual meter prior to the given spin further comprises instructions that cause the at least one processor to determine a total credit value of all of the credit symbol that triggered a supplemental game feature with the repeat accrual meter.

15. The non-transitory computer-readable medium of claim 1, wherein the random based game outcome includes an add spins symbol.

16. The non-transitory computer-readable medium of claim 1, wherein the random based game outcome includes having a second credit symbol, and wherein the instructions further cause the at least one processor to add, prior to determining the total credit value meter distribution amount, a second credit value of the second credit symbol the initial credit value to generate the accumulated credit value.

17. The non-transitory computer-readable medium of claim 1, wherein the random based game outcome is for a reel game.

18. The non-transitory computer-readable medium of claim 1, wherein the instructions further cause the at least one processor to trigger a supplemental game feature that includes the repeat accrual meter from a second supplemental game feature.

19. The non-transitory computer-readable medium of claim 1, wherein the instructions further cause the at least one processor to trigger a supplemental game feature that includes the repeat accrual meter from a base game.

20. A method of controlling an electronic gaming device, the method comprising:

determining an initial credit value for a repeat accrual meter prior to a given spin;

randomly selecting a reel pattern set, from a plurality of reel pattern sets, to configure a set of reels for one or more spins to ensure that at least one target symbol lands in the one or more spins, the one or more spins including the given spin;

outputting the initial credit value in a first portion of a display;

outputting the randomly selected reel pattern set in a second portion of the display, wherein the first portion of the display and the second portion of the display are non-overlapping;

generating, using the set of reels configured according to the reel pattern set, a random based game outcome for the given spin, wherein the random based game outcome includes having a credit symbol and a given target symbol of the at least one target symbol;

determining an accumulated credit value for the repeat accrual meter based on adding a credit value of the credit symbol to the initial credit value;

randomly determining a repeat value by triggering a repeat credit operation based on the given target symbol from the generated random based game outcome and the randomly selected reel pattern set, wherein the repeat value is indicative of a number of times to credit the accumulated credit value;

determining a total credit value based on the accumulated credit value and the repeat value;

presenting one or more first animations in a third portion of the display to decrement a remaining spin count; and presenting one or more second animations in the first portion of the display to update the initial credit value to the determined total credit value.

21. The method of claim 20, further comprising, as part of configuring the set of reels for the one or more spins:

replacing the one or more reel strips of the set of reels, for the reel pattern set, with a unique reel strip, wherein the unique reel strip is constructed to guarantee landing on the at least one target symbol for the given spin.

* * * * *